US006708849B1

(12) United States Patent
Carter et al.

(10) Patent No.: US 6,708,849 B1
(45) Date of Patent: Mar. 23, 2004

(54) ACTUATOR AND TUBE OVERCAP ASSEMBLY

(75) Inventors: Randall E. Carter, Waynesfield, OH (US); Leslie F. Kohli, Cridersville, OH (US); Brian D. Schumacher, Wapakonetta, OH (US)

(73) Assignee: Precision Thermoplastic Components, Inc., Lima, OH (US)

( * ) Notice: Subject to any disclaimer, the term of this patent is extended or adjusted under 35 U.S.C. 154(b) by 22 days.

(21) Appl. No.: 10/100,774

(22) Filed: Mar. 18, 2002

(51) Int. Cl.[7] ..... B65D 83/20

(52) U.S. Cl. ..... 222/153.1; 222/402.13; 222/528; 222/529; 222/530

(58) Field of Search ..... 222/153.1, 153.11, 222/394, 402.1, 402.13, 402.15, 527, 528, 529, 530, 538

(56) References Cited

U.S. PATENT DOCUMENTS

| | | | | | |
|---|---|---|---|---|---|
| 3,055,556 | A | | 9/1962 | Hester | |
| 4,096,974 | A | * | 6/1978 | Haber et al. | 222/402.13 |
| 4,305,528 | A | | 12/1981 | Craig | |
| 4,315,576 | A | | 2/1982 | Murphy | |
| 4,664,300 | A | * | 5/1987 | Strickland | 222/402.13 |
| 4,819,838 | A | | 4/1989 | Hart | |
| 5,098,603 | A | * | 3/1992 | Perlman | 252/182.29 |
| 5,305,784 | A | | 4/1994 | Carter | |
| 5,611,466 | A | | 3/1997 | Hsiao | |
| 5,765,601 | A | | 6/1998 | Wells et al. | |
| 6,260,739 | B1 | | 7/2001 | Hsiao | |
| 6,382,469 | B1 | * | 5/2002 | Carter et al. | 222/153.06 |

* cited by examiner

*Primary Examiner*—Gene Mancene
*Assistant Examiner*—Patrick Buechner
(74) *Attorney, Agent, or Firm*—Robert R. Hussey Co., LPA

(57) ABSTRACT

An actuator and tube overcap assembly has an actuator having an inlet and an outlet. A tube has a fluid passageway therethrough and an inlet end connected to the outlet of the actuator and an extension portion extending therefrom. An overcap is removably affixed to the actuator and has a top and a side extending therefrom. The top and side of the overcap have an inner surface. The overcap has internal tube retaining portions having a tube retaining surface. The tube retaining surface extends away from the inner surface of the top and is spaced from the inner surface of the side with the tube extension positioned therebetween. A valve is provided by substantially closing the fluid passageway of the tube. A method for making the assembly is also provided.

63 Claims, 11 Drawing Sheets

ACTUATOR AND TUBE OVERCAP ASSEMBLY

BACKGROUND OF THE INVENTION

The present invention relates in general to actuator and tube overcap assemblies adapted for installation onto a pressurized container and more particularly to actuator and tube overcap assemblies that can be installed onto the pressurized container with automated machinery.

A wide variety of actuators and tubes for selectively releasing material from a pressurized container and conducting that material to a selected destination are known. One specific application for these actuators or valves and tubes is tire inflator containers that contain various tire inflator and sealant products.

Modern pneumatic tires are designed for extended use on vehicles, such as automobiles and trucks, over many miles. Regardless of how well these tires are designed, they can still be punctured by sharp objects inadvertently left on the roadway and go flat. When the tire is punctured, the motorist must change the tire if he has a spare or have another tire put on the vehicle. In some instances, it is difficult to change the tire due to the location of the vehicle, such as when the puncture occurs on roadway which is not flat and the vehicle cannot be safely raised with a jack to change the tire. Other instances are dangerous to change the tire, such as for example, when the tire is punctured on a heavily traveled roadway and there is insufficient space to change the tire safely.

Various tire inflator and sealant products have been developed for both sealing the puncture in a tire and also inflating the tire so that it can be used to resume travel. These tire inflator and sealant products generally include a container having a inflator and sealant composition contained therein under pressure. This composition is releasable through an upstanding valve in the discharge end of the container. These compositions in the container typically include a liquefied gas in a sufficient quantity to reinflate the tire to a driveable condition and a sealant material for sealing the puncture when introduced into the tire.

An actuator is provided for attachment to the pressurized container to activate the upstanding valve of the container so that the inflator and sealant composition passes through the valve and then through the actuator to a discharge tube attached to the valve on the tire. In operation, the motorist attaches the discharge tube to the valve on the punctured tire and then properly positions the canister to maximize the flow of the inflator and sealant composition into the tire.

Since such tire inflator products contain the tire inflator and sealant material in the pressurized container under high-pressure, it is desirable to attach the discharge tube to the actuator when the actuator and tube product is manufactured. By providing a secure connection between the discharge tube and actuator, a connection is provided that prohibits leakage of material at that connection when material is discharged from the pressurized container.

One such design is described in U.S. Pat. No. 5,305,784, issued to one of the inventors of the present invention, and provides for the attachment of a flexible tube to a valve. Another such design is disclosed in U.S. Pat. No. 5,611,466. Another design for attaching the tube to the valve includes positioning the tube over a barbed outlet of the valve and then fitting a non-flexible sleeve over the end of the tube attached to the barbed outlet.

The actuator and tube product is then provided to the manufacturer of the tire inflator product where the actuator and tube product is assembled with a pressurized canister having tire inflator and sealant material therein. General this assembly process is performed by hand since automation of the assembly process is difficult due to the nonsymmetrical shape of the actuator and tube assembly. The flexible tube extending from the actuator creates this nonsymmetrical configuration that makes it difficult to automatically assemble the actuator tube product to the pressurized container. Accordingly, these actuator tube products have necessarily been mounted on the pressurized container manually.

Additionally, the flexible tube requires additional manufacturing operations. Since the tube is not secured, it is free to move. To avoid this problem, the tube has been temporarily secured to the pressurized container by manually putting a rubber band around both the container and the tube. After this assembly process, the assembled tire inflator product must be hand packed for shipping since the temporarily attached tube prevents automated packaging. Then, when the assembled tire inflator product is displayed in a store on shelves, it can be difficult to arrange them neatly on the shelves and they can also take up more shelf space due to the tube secured to the side of the container. After the consumer purchases the tire inflator product, it is generally placed in the trunk where the tube can get tangled up with other objects in the trunk and damage the connection between the tube and the actuator or the actuator and the pressurized container.

It is desirable to provide an actuator and tube overcap assembly which can be assembled with a pressurized canister by automatic machinery. It is also desirable to provide an actuator and tube overcap assembly which contains the tube in a position that allows for automated packing, ease of display on store shelves, and avoids tangling the tube with other objects.

Known designs have provided overcap assemblies that can be assembled with a pressurized container by automatic machines, generally referred to as "capping machines". Generally, overcap assemblies that can be readily assembled with automatic machinery have a symmetrical configuration and a top surface that can be used to urge the overcap assembly into engagement with the pressurized canister without actuating the actuator.

Wells, in U.S. Pat. No. 5,765,601, describes a valve and tube assembly in which a conduit is attached to the actuator body and a protective cap is preassembled onto the actuator body in overlying relationship to the conduit. The conduit described in Wells extends axially away from the pressurized container when mounted thereon and may be coiled or of other nonlinear configurations. The conduit provided by Wells is relatively short and is made from a resilient material, typically a polymer, such as polyvinyl chloride, high density polyethylene, low density polyethylene, or polypropylene. The protective cap described in Wells fits over the conduit, which is free to move inside the protective cap, and is attached to the actuator. The cap disclosed in Wells is attached to the actuator and not the canister with a limited amount of space which accordingly limits the length of the conduit.

Another known overcap assembly is described in Hsiao, U.S. Pat. No. 6,260,739 B1. The Hsiao design provides a base having a skirt that extends over the lower rim of the canister when they are mounted together. The base is bulky and large in size and in fact is the diameter of the entire cannister. A valve is provided in the top of the base with a flexible tube attached to the outlet of the valve. A cap is attached to the base with the tube positioned between the base and the cap and free to move in that space. In other embodiments, Hsiao discloses not providing an overcap and affixing the tube to the base with an adhesive, mechanical fasteners, such as flexible wires, or a shrink sleeve. Attaching the tube around the exterior of the valve without a base and cap is also disclosed. Such alternative embodiments without an overcap are difficult to use with automated machinery due to the unsymmetrical configuration thereof and the need for a top surface to press the assembly into engagement with a pressurized canister.

The known art does not disclose an actuator and tube overcap assembly in which the tube is removably secured to the inside of an overcap to allow automatic assembly thereof and subsequently allow automated machinery to assemble it with a pressurized container. It is desirable to provide an actuator and tube overcap assembly that provides for securing the tube to the overcap without the need for additional components, such as a adhesives, mechanical fasteners or shrink sleeves or the like. Such additional components do not lend themselves to automatic assembly of the actuator and tube and also increase the costs of such a product. It is desirable to provide an actuator and tube overcap assembly in which the actuator, tube and overcap can be assembled with automatic equipment.

It is also desirable to provide an actuator and tube overcap assembly which has a top surface that can be used to urge the overcap assembly into engagement with a pressurized canister without actuating the actuator. It is desirable to provide an actuator and tube overcap assembly that effectively transmits the force exerted on the top surface of the overcap to the actuator.

Various applications in which an actuator and tube overcap assembly is used require tubes of differing lengths. For example, some tire inflator products require the pressurized container to be inverted and other tire inflator products require the pressurized container to be in an upright position. Yet other tire inflator products use different actuators or valves to release the pressurized contents from the pressurized container. Another application for an actuator and tube overcap assembly is for use with an air conditioning recharge container. Depending on the design of the application, differing lengths of tubes are preferable. Accordingly, it is desirable to provide an actuator and tube overcap assembly where the tube can be of differing lengths depending on the specific application.

After the actuator and tube overcap assembly is assembled with the pressurized canister, it is desirable to avoid discharge of the contents of the pressurized container until the tube is attached to the tire and the actuator is intentionally actuated. It should be recognized that a variety of circumstances exist in which the pressurized contents of the container are inadvertently or accidentally released. Accordingly it is desirable to provide a secondary valve in addition to the actuator to seal the pressurized contents in the container.

The known overcap art strives to keep the fluid passage of the tube open when it is assembled with the actuator and overcap. In fact, Hsiao even provides a stress relief spring to be affixed around the hose to avoid kinking. Due to the high pressures in the pressurized container, the tube must have sufficient strength to handle these pressures and allow the pressurized material to flow through the tube. The known art, as described in Wells, has provided a tube of resilient material, typically a polymer, such as polyvinyl chloride, high density polyethylene, low density polyethylene or polypropylene. These materials when bent, take a permanent set and resist the flow of pressurized material therethrough. Accordingly, it is desirable to provide a tube that can be deformed to seal the passageway therethrough and when no longer deformed allows the pressurized material to flow therethrough.

SUMMARY OF THE PRESENT INVENTION

The present invention provides the above described desirable features with an improved actuator and tube overcap assembly for automated installation onto a pressurized container. In addition, the actuator and tube overcap assembly of the present invention is capable of assembly with automated equipment.

The actuator or valve of the assembly of the present invention has an inlet end for attachment to the pressurized container. When the actuator is activated, material is released from the container and flows through the actuator and out the outlet end of the actuator. The flexible discharge tube has an inlet end fluidically connected to the outlet of the actuator and an extension portion extending from the inlet end of the tube. The extension portion terminates in an outlet end that has a connector attached thereto. The connector is provided for attachment to a fitting on the destination of the pressurized material, such as a tire or air conditioning system.

An overcap is removably affixed to the actuator with a latch which allows for attachment and detachment of the overcap from the actuator. When the overcap is to be affixed to the actuator, an axial force urges the overcap and actuator together so that the latch engages and holds the actuator and overcap together. The overcap has stabilizer portions extending from the overcap which contact the actuator to restrain movement of the overcap in the attached position. These stabilizer portions effectively transmits the force exerted on the top surface of the overcap to the actuator when the actuator and tube overcap assembly is assembled with the container. Such a design allows for automated assembly of the actuator and overcap without the need for other components. As will be hereinafter more fully described, in the assembled position the tube is removably attached to the overcap.

The latch allows for disengagement of the actuator and overcap so that the overcap may be unattached from the actuator. In the unattached position, the tube may be removed from the overcap, the connector attached to a fitting on the destination of the pressurized material and pressurized material transferred from the pressurized container.

To secure the tube to the overcap when the actuator, tube and overcap are assembled, the overcap has a top and a side extending at an angle from the top to a bottom edge. The top and side of the overcap both have inner surfaces contiguous with each other. The overcap has internal tube retaining portions, each of which have a tube retaining surface. The tube retaining surfaces extend away from the inner surface of the top and are spaced from the inner surface of the side. The tube is positioned between the tube retaining surface and the inner surface of the side of the overcap. The tube has an undeformed diameter and the tube retaining surfaces are spaced from the the side a distance less than the undeformed diameter of the tube extension portion to hold the tube therebetween.

Accordingly, when the tube is positioned between the internal tube retaining portions and the side of the overcap, it is removably affixed to the overcap. By so removably affixing the tube to the overcap, an actuator and tube overcap assembly is provided without the need for additional components, such as a base, adhesives, mechanical fasteners or shrink sleeves or the like. Such a design allows for automatic assembly of the actuator and tube overcap assembly.

Another feature of the present invention that provides for the automatic assembly of the actuator and tube overcap assembly is restraining the movement of the connector on the tube outlet end with either the overcap or actuator and without additional components. The connector has a circumference greater than the circumference of the tube. When the tube is positioned between the tube retainers and the side with the connector above the actuator, the connector is held in position by contact with the top of the actuator and the side of the overcap. When it is desirable to position the connector in other positions, a tube holding protrusion is provided on the inner surface of the overcap side which holds the connector in position. Such designs in the present invention provides for constraining movement of the connector on the tube to with the overcap and/or the actuator without additional components.

Another feature of the present invention that provides for the automatic assembly of the actuator and tube overcap assembly of the present invention is that the overcap side and the tube retaining surface diverge as they extend away from the inner surface of the top to the bottom of the tube retaining surface. The tube is automatically assembled between the space between the tube retaining surface and the overcap side by positioning the tube adjacent the bottom of the tube retaining surface. The tube extension is then urged towards the top of the overcap in the space therebetween. As the tube extension moves towards the top of the overcap, the converging tube retaining surface and overcap side grip the tube so that it is removably retained therein. Since the space is greater between the bottom of the tube retaining surface and the side, automatic assembly of the tube and the overcap is more readily provided.

The actuator and tube overcap assembly of the present invention allows for the use of tubes of differing lengths so that it can be used in a variety of different applications. By changing the height of the overcap or the outside periphery of the overcap or in other instances simply using additional tube lengths, tubes of widely varying lengths can be removably attached to the overcap.

The actuator and tube overcap assembly of the present invention provides a secondary valve, in addition to the actuator, to seal the pressurized contents in the container. This secondary valve is provided by the tube which can be deformed to seal the passageway therethrough and when no longer deformed allows the pressurized material to flow therethrough. To achieve this secondary valve feature, the side of the overcap is positioned adjacent the outlet of the actuator a distance that closes the fluid passageway of the tube positioned between the overcap side and the outlet of the actuator. It has been found that plastic material having particular material characteristics achieves the above described features of providing a secondary valve and is also capable of handling the pressures exerted thereon when the material is discharged from the container. A tube having these particular material characteristics is sufficiently flexible to seal when deformed by the overcap forcing the tube against the actuator outlet. In addition, when such a tube is disassembled from the overcap it allows pressurized material to flow therethrough and has sufficient strength to handle the pressure of the pressurized material.

DETAILED DESCRIPTION OF THE INVENTION

Figure 1:
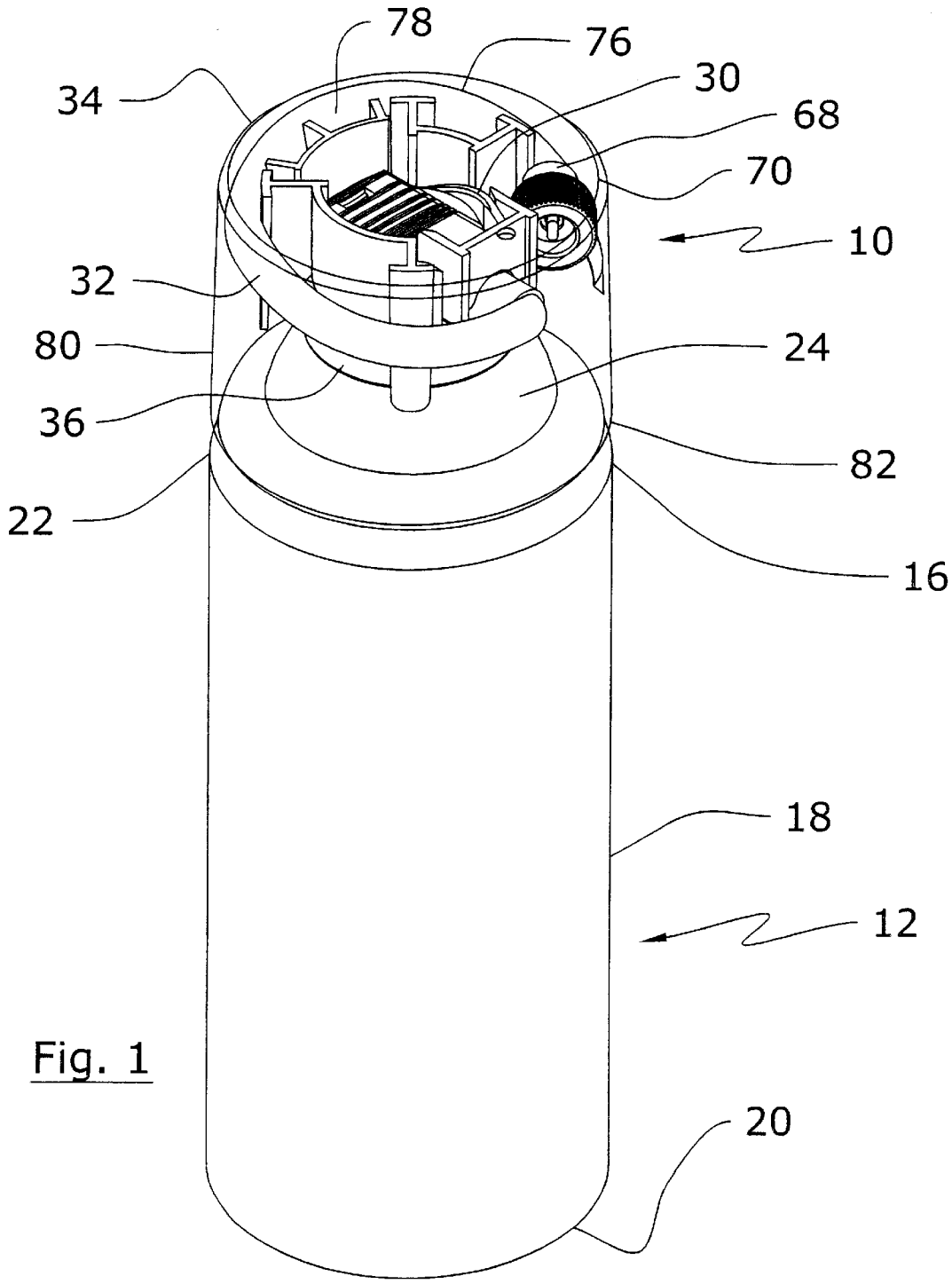
FIG. 1 is a perspective view of the actuator and tube overcap assembly of the present invention attached to a pressurize container.
Figure 2:
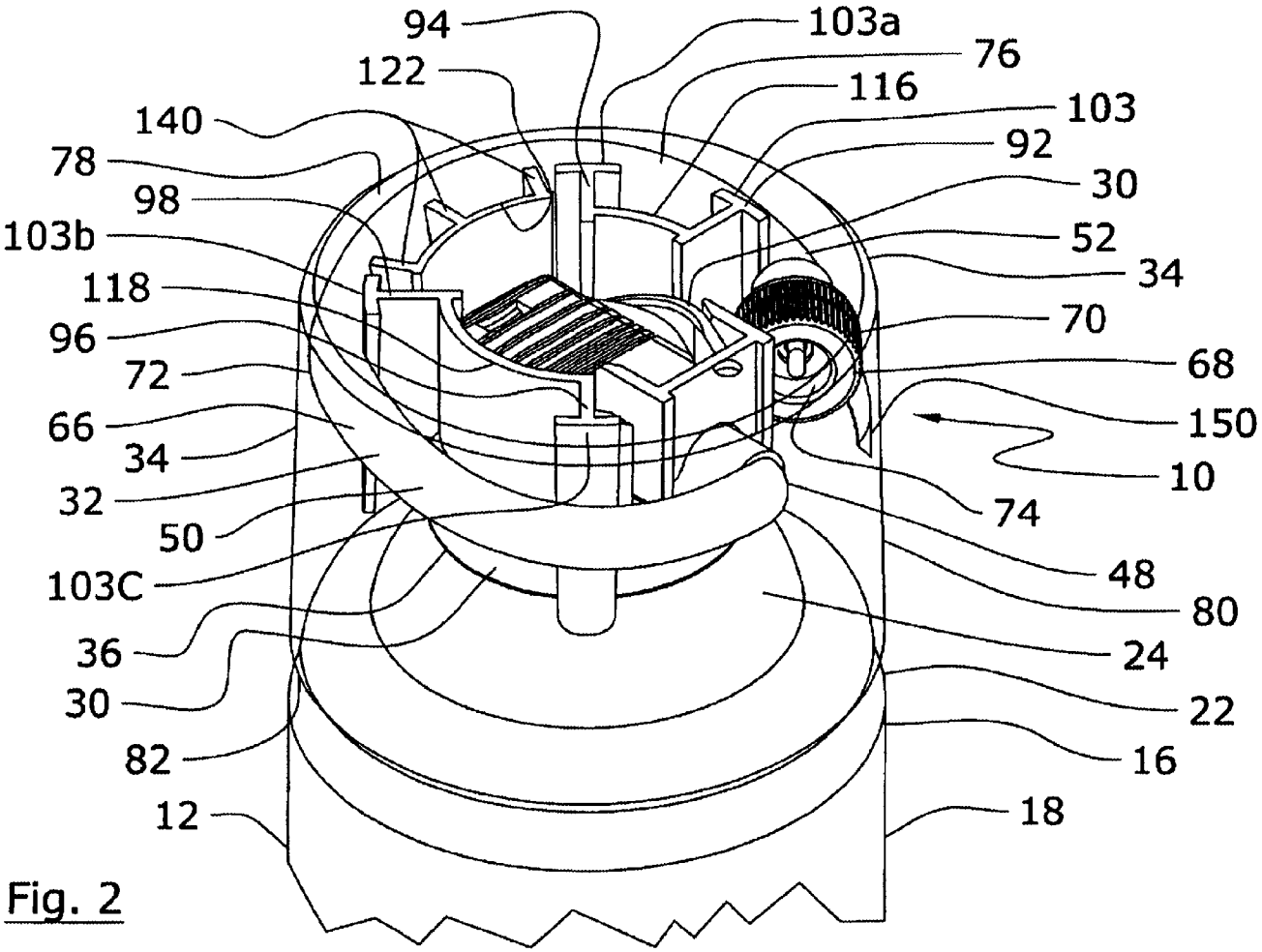
FIG. 2 is an enlarged perspective view of the actuator and tube overcap assembly shown in FIG. 1.

The present invention provides an improved actuator and tube overcap assembly 10 for automated installation onto a pressurize container 12, as shown in FIGS. 1 and 2, which actuator and tube overcap assembly 10 is capable of assembly with automated equipment.

Figure 3:
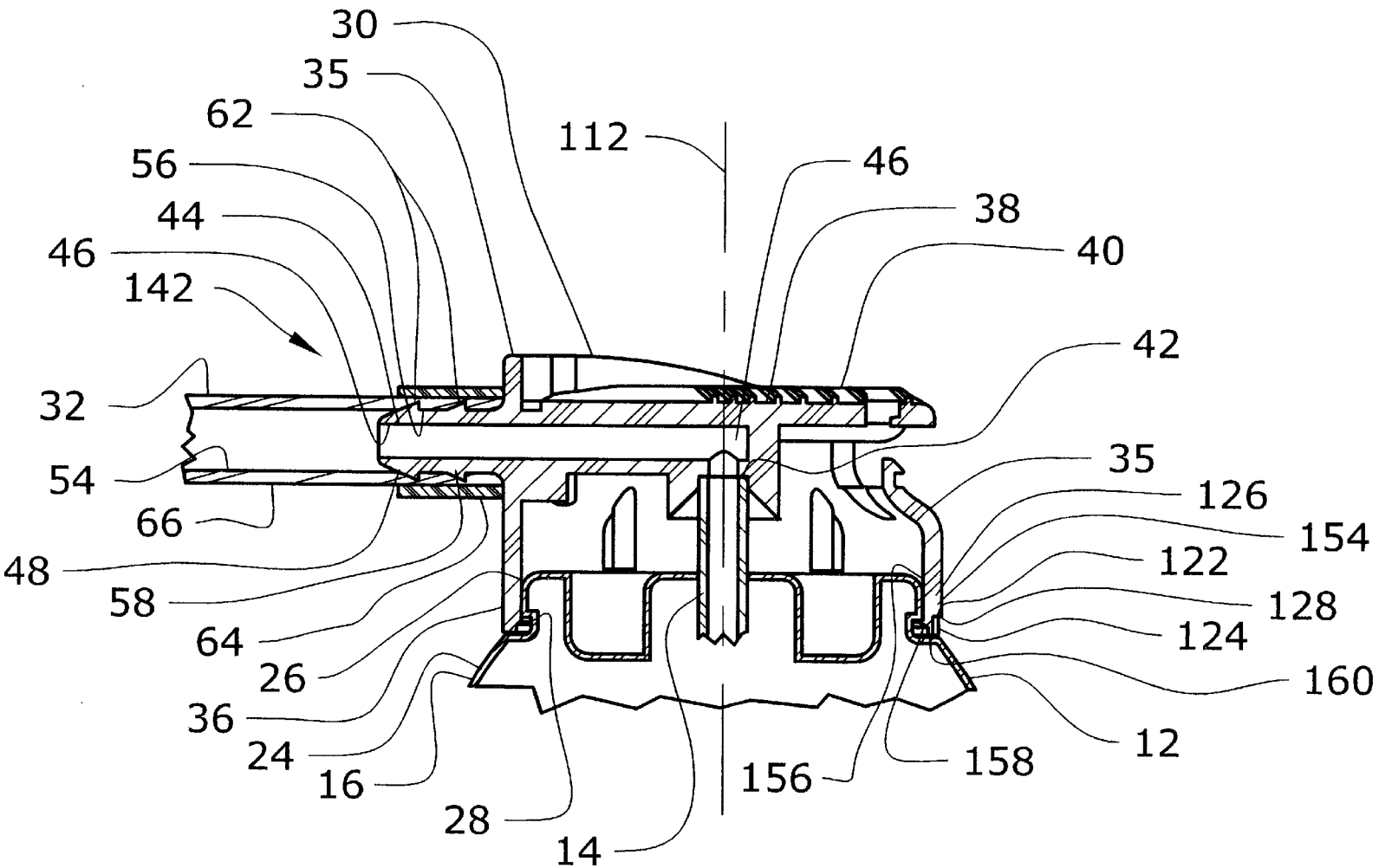
FIG. 3 is a cross sectional view of the actuator shown in the actuator and tube overcap assembly shown in FIG. 1.

The pressurized container 12 on which the actuator and tube overcap assembly 10 is mounted may be of a wide variety of constructions and designs and for different purposes. The container 12 contains pressurized material, such as for example, tire inflator and sealant compositions, air conditioning recharge material and other aerosol dispensing applications. For purposes of illustration, the pressurize container 12 will be described as a tire inflator product in which the pressurize container 12 has an inflator and sealant composition contained therein under pressure. This composition is releasable through an upstanding valve 14 in the discharge end 16 of the container 12, as shown in FIG. 3. These compositions typically include a liquefied gas in a sufficient quantity to reinflate the tire to a driveable condition and a sealant material for sealing the puncture when introduced into the tire.

The pressurize container 12 shown is generally recognized as an aerosol can and has an outer peripheral surface 18 which generally extends the length of the container from its bottom 20 to the discharge end 16 of the container. The outer peripheral surface 18 terminates at an upper rim 22 of the discharge end 16. The discharge end 16 includes a discharge end surface 24 extending generally upwardly and radially inwardly of the upper rim 22. The discharge end surface 24 terminates in a top rim 26 having a radially inward depression 28 formed therein. The valve 14 of the container 12 is generally centrally located in and extends from the top rim 26. It should be understood that the valve 14 in the discharge end 16 of the pressurize container 12 and the construction of the discharge end may be of a variety of known constructions and designs and for different purposes and applications.

The improved actuator and tube overcap assembly 10 of the present invention has an actuator 30, a flexible discharge tube 32 and an overcap 34, as shown in FIGS. 1–3. The actuator 30 may be of any design, such as the actuator described in applicants allowed copending United States Patent Application entitled "Tire Inflation Actuator", Ser. No. 09/919,548, filed Jul. 31, 2001 which describes the operation thereof and movement of the actuator between a closed and a discharge position and is incorporated herein by reference.

The actuator 30 has a generally cylindrical body 35 having an inlet end 36 for attachment to the discharge end 16 of the container 12 and is in fluid communication with the valve 14 of the container as will hereinafter be more fully described. It should be understood that the actuator 30 includes any valve movable between a closed and a discharge position in which the contents of the pressurized container 12 are discharged therefrom.

The actuator 30 has a valve portion 38 housed in a finger tab 40. The valve portion 38 has an inlet 42 and an outlet 44 with a fluid passageway 46 connecting the inlet and outlet of the valve portion. When the actuator 30 is mounted on the container 12, as will be hereinafter described, the finger tab 40 is depressed and the actuator is activated. The valve 14 of the canister 12 is thereby activated so that pressurized material flows through the passageway 46 and out the outlet end of the actuator.

It is within the contemplation of this invention to utilize the invention with a variety of different actuators that are securable to the discharge end 16 of the container 12 and are operable to discharge the contents of the container into the tube 32. It is also within the contemplation of this invention to utilize the invention with a variety of different canister valves.

The flexible discharge tube 32 has an inlet end 48, an extension portion 50 and an outlet end 52 with a fluid passageway 54 passing between the ends 48, 52. To connect the tube 32 to the outlet 44 of the actuator 30 so that the passageways 46 and 54 are connected, the inlet end 48 of the tube is slid over the outside surface 56 of the barbed connector portion 58 defining the outlet 44. The inner wall 60 defining the passageway 54 contacts the outside surface 56 of the barbed connector portion 58. The outside surface 56 has barbs 62 thereon which allow for movement of the inlet end 48 of the tube 32 onto the barbed connector portion 58 and restrain movement in the opposite direction.

The outside surface 56 is larger than the passageway 54 and the barbs 62 are even larger. The tube 32 is flexible and is deformed when it is moved over the barbed connector portion 58. In this assembled position, the tube 32 is frictionally attached by frictional force to the barbed connector portion 58. A securing ring 64 is then positioned around the outside 66 of the tube 32 to secure the tube and actuator 30 together. Accordingly, the passageways 46 and 54 are connected. Known automatic equipment provides for accomplishing this connection between the actuator 30 and tube 32. It is within the contemplation of this invention to attach the tube 32 and actuator 30 in any known manner in which the fluid passageways 46 and 54 are connected.

The extension portion 50 of the flexible discharge tube 32 terminates in an outlet end 52 that has a connector 68 attached thereto. The connection between the outlet end 52 of the tube 32 and a connector 68 is similar to that described above in connection with the connection between the outlet 44 of the actuator 30 and the inlet end 48 of the tube. The connector 68 is provided for attachment to a fitting on the destination of the pressurized material, such as a tire or air conditioning system. The connector 68 is adapted to connect with a tire valve and fluidically connect the tire valve to the outlet end 52 of the tube 32. The connector 68 is provided for conducting the material passing through the tube 32 into the destination of the pressurized material, such as the tire valve.

The connector 68 as an outer periphery 70 which is larger than the outer periphery 72 of the tube 32, defined by the outside 66 of the tube 32. The outer periphery 70 of the connector 68 is generally knurled to allow ready gripping thereof by the operator so that the inner threaded surface 74 can threadedly engage the tire valve, not shown. In an undeformed condition, the outer periphery 72 of the tube 32 is generally circular, as is the outer periphery 70 of the connector 68. Known automatic equipment provides for assembling the connection between the connector 68 and tube 32. It is within the contemplation of this invention to attach the tube 32 and connector 68 in any known manner in which the fluid passageway 54 it is connected to the connector 68. It should be understood that it is also within the contemplation of this invention to utilize connectors of a wide variety of designs and constructions, for example tire inflator and sealant compositions, air conditioning recharge material and other aerosol dispensing applications.

The overcap 34 of the present invention is provided to hold the tube 32 in an assembled position 76 when the overcap 34 is removably attached to the actuator 30. Accordingly, the actuator and tube overcap assembly 10 may be automatically assembled with the pressurize container 12 without requiring additional components to hold the tube 32 in an assembled position as will hereinafter be more fully described.

As shown in the drawings, the overcap 34 is preferably made from transparent or translucent material so that the consumer can identify the product. Of course, the overcap 34 may be of any other material. The overcap 34 has a top 78 and a side 80 extending at an angle from the top 78 to a bottom edge 82. The top 78 of the overcap has an outer and inner surface 84, 86 respectively and the side 80 has an inner and outer surface 88, 90 respectively. The inner surface 88 of the side 80 is contiguous with the inner surface 84 of the top 78 and extends at an angle thereto.

The overcap 34 has internal tube retaining portions 92, 94, 96, and 98 as shown in FIGS. 1–8 to hold the tube 32 in an assembled position 76. The internal tube retaining portions 92, 94, 96, and 98 are positioned about the periphery of and adjacent to the inner surface 88 of the side 80 to hold the tube 32 in the assembled position 76.

Figure 4:
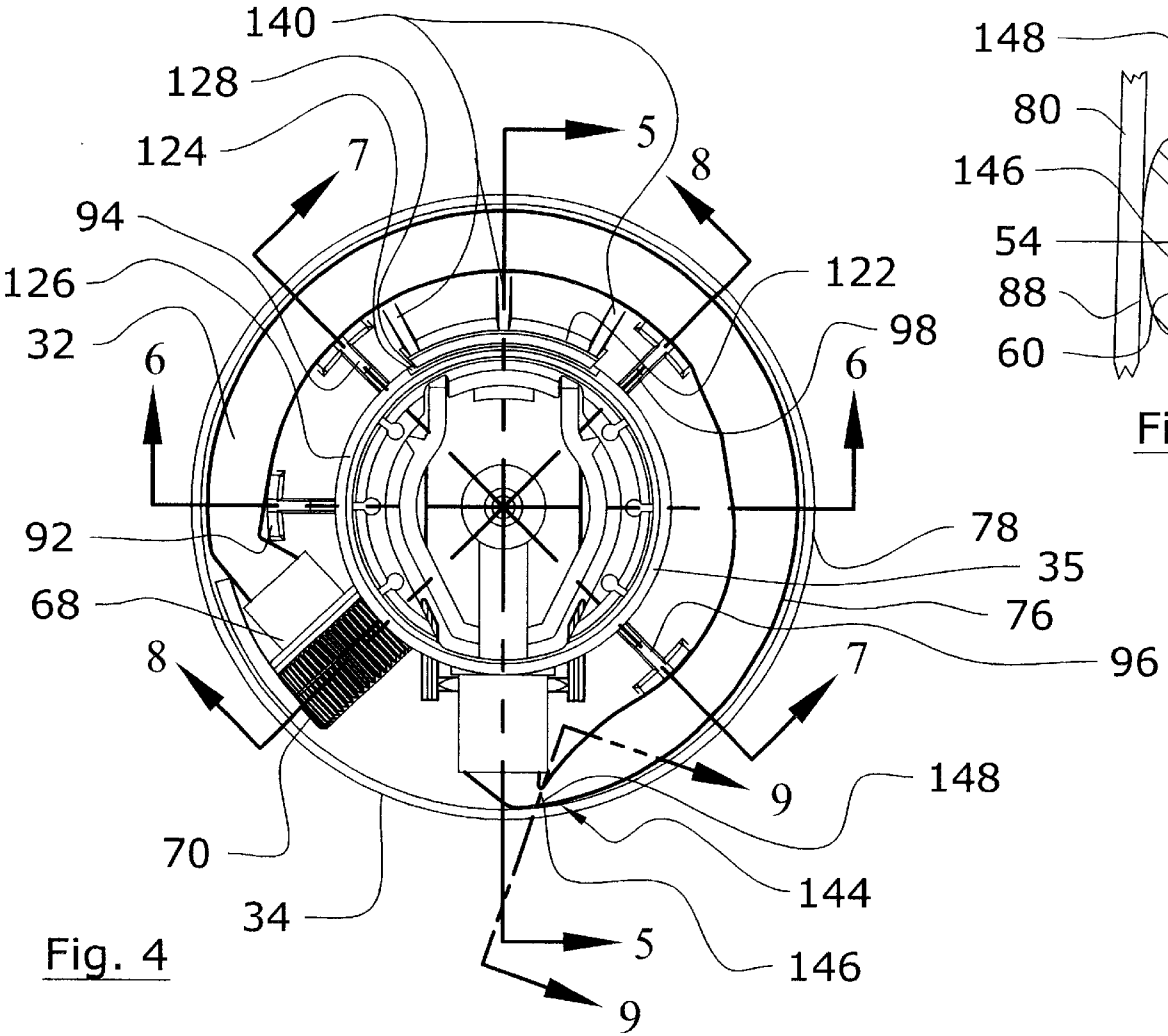
FIG. 4 is a bottom view of the actuator and tube overcap assembly shown in FIG. 1.
Figure 6:
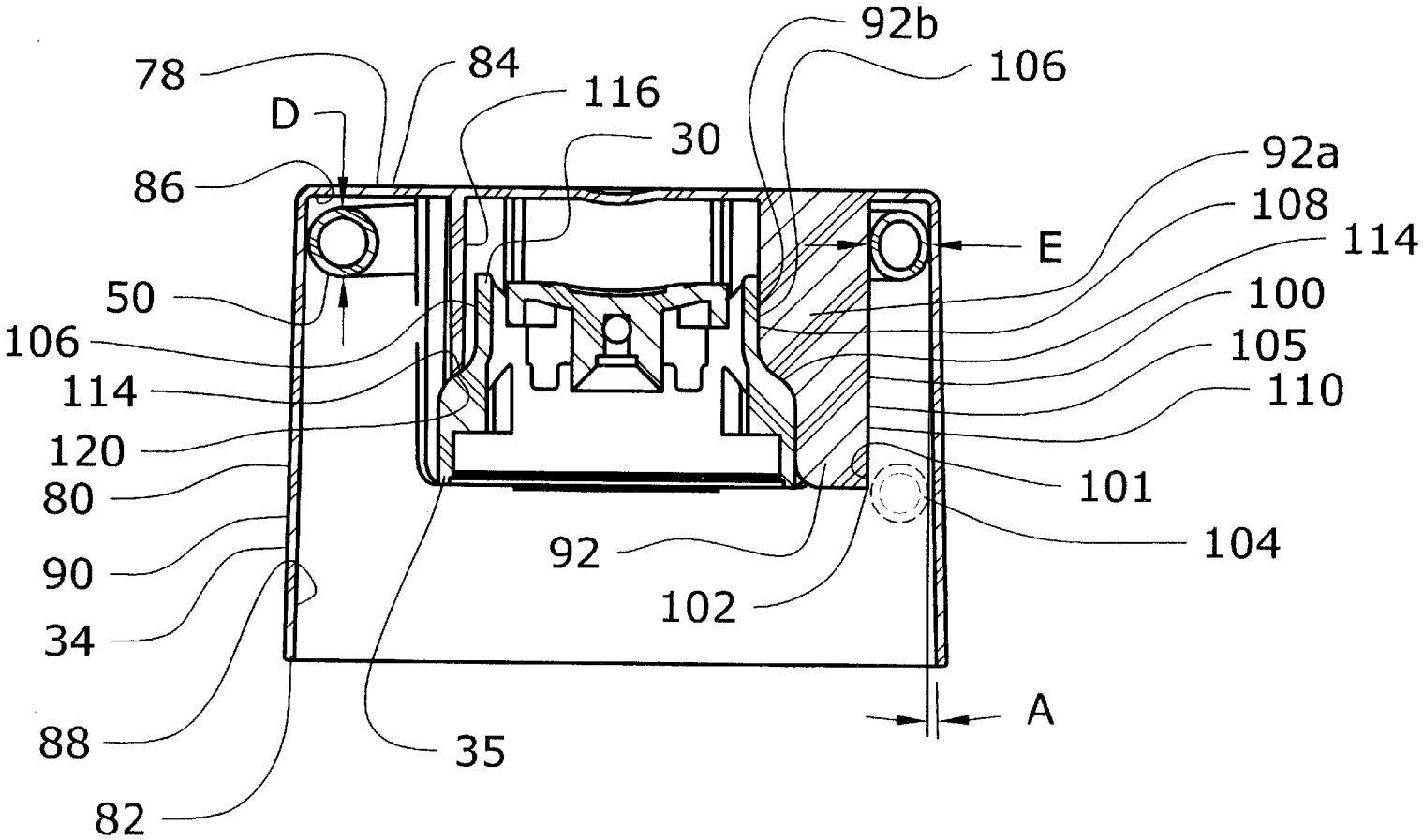
FIG. 6 is a sectional view of the actuator and tube overcap assembly shown in FIG. 4 and take along lines 6—6 thereof.
Figure 7:
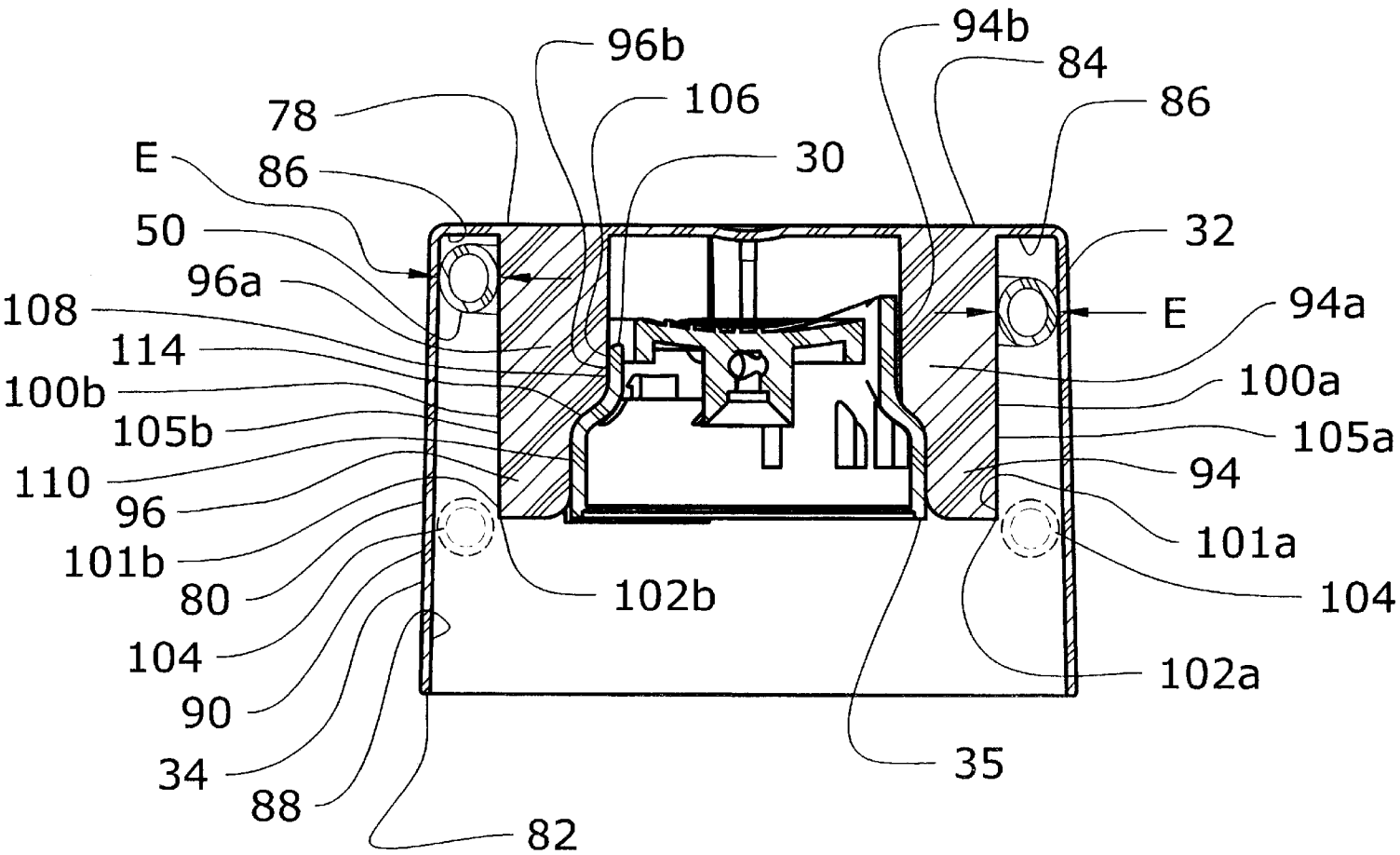
FIG. 7 is a sectional view of the actuator and tube overcap assembly shown in FIG. 4 and take along lines 7—7 to the thereof.

As shown in FIGS. 2, 4 and 6, the internal tube retaining portion 92 is formed integrally with the overcap 34 and has a tube retaining surface 100 which extends from the inner surface 86 of the overcap top and terminates at an unattached lower edge 102. The tube retaining surface 100 has a width 103 that spreads the retaining force over a distance of the tube that is sufficient to avoid kinking of the tube and hold it in position as described below. It is within the contemplation of this invention that the tube retaining surface 100 may be of any width.

The tube retaining surface 100 is spaced from the inner surface 88 of the side 80. The distance between the surfaces 100, 88 is greater at the unattached lower edge 102 than at the inner surface 86 of the overcap top. The tube retaining surface 100 extends at substantially 90 degrees from the inner surface 86 of the top while the inner surface 88 of the side 80 extends at substantially 90 degrees plus the angle A, shown in FIG. 6, from the inner surface 86 of the overcap top. Accordingly, the inner surface 88 of the side 80 extends at an angle greater than 90 degrees from the inner surface 86 of the overcap top.

It should be understood that it is within the contemplation of this invention to provide any combination of angles at which the tube retaining surface 100 and inner surface 88 of the side 80 extends from the inner surface 86 of the overcap top so that the distance between the surfaces 100, 88 is greater at the lower edge 102 than where those surfaces 100, 88 are closer to the inner surface 86 of the overcap top. The surfaces 100, 88 diverge in a direction away from the inner surface 86 of the overcap top. It should also be understood that while it is preferable for the surfaces 100, 88 to so diverge, it is within the contemplation of this invention that they may be parallel to each other or even converge with respect to each other. It is also within the contemplation of this invention that the inner surface 88 of the side 80 may extend at a range of both obtuse or acute angles with respect to the inner surface 86 of the overcap top.

The extension portion 50 of the tube 32 has an undeformed diameter D as shown in FIG. 6. The distance between the surfaces 100, 88 is greater than the undeformed diameter D at the lower edge 102 of the internal tube retaining portion 92. The lower edge 102 of the internal tube retaining portion 92 defines the beginning of the lower portion 101 of the tube retaining surface. The lower portion 101 of the tube retaining surface is spaced from the inner side 88 of the overcap a distance greater than the undeformed diameter D. It should be understood that the lower portion 101 may extend upwardly from the lower edge 102 of the internal tube retaining portion 92 a small distance so as to allow entry of the tube extension 50 into the space between the surfaces 100, 88.

The distance between the surfaces 100, 88 as they are closer to the inner surface 86 of the overcap top are less than the undeformed diameter D to hold the tube in an assembled position. The upper portion 105 of the tube retaining surface 100 is defined by the portion of the tube retaining surface that is spaced from the inner surface 88 a distance less than the undeformed diameter D. The upper portion 105 of the tube retaining surface 100 extends from the inner surface 86 of the overcap top to the lower portion 101 and includes the portion of the tube retaining surface 100 that contacts the tube extension 50 when in an assembled position 76.

To assemble the tube and the overcap, the tube 32 is positioned in an assembly position 104 in a perimeter to fit in the space between the surfaces 100, 88 and is positioned adjacent the lower edge 102 and the lower portion 101 of the tube retaining surface. The tube 32 may be positioned between the surfaces 100, 88 by urging the tube towards the overcap top. As the tube is so moved, it is compressed from its undeformed diameter D when in the upper portion 105 of the tube retaining surface 100 to a deformed diameter E and frictional forces hold the tube in the space between the surfaces 100, 88.

When the tube is so positioned between the internal tube retaining portion 92 and the side 88 of the overcap, it is removably affixed to the overcap. By so removably affixing the tube to the overcap, an actuator and tube overcap assembly 10 is provided without the need for additional components, such as adhesives, mechanical fasteners or shrink sleeves or the like. Furthermore, this design and assembly process provides an actuator and tube overcap assembly 10 which may be assembled with automated equipment.

The other internal tube retaining portions 94, 96, and 98 are shown in FIGS. 2, 4, 7 and 8 and are similar in construction to the tube retaining portion 92. For ease of description, the tube retaining portions 94, 96, and 98 are numbered with the same numerals as used in connection with the internal tube retaining portion 92 to denote common portions where appropriate and followed by a the suffixes a, b, c respectively.

The internal tube retaining portions 94, 96, and 98 are formed integrally with the overcap 34 and have tube retaining surfaces 100*a*, 100*b*, 100*c* respectively which extend from the inner surface 86 of the overcap top and terminate at the unattached lower edges 102*a*, 102*b*, 102*c* respectively. The tube retaining surfaces 100*a*, 100*b*, 100*c* have a width 103*a*, 103*b*, 103*c* respectively, that spreads the retaining force over a like distance of the tube that is sufficient to avoid kinking of the tube and hold it in position as described herein. It is within the contemplation of this invention that the tube retaining surfaces 100*a*, 100*b*, 100*c* may be of any width.

The tube retaining surfaces 100*a*, 100*b*, 100*c* are spaced from the inner surface 88 of the side 80 wherein the distance between the surfaces 100*a*, 100*b*, 100*c* and the inner surface 88 of the side 80 is greater at the lower edges 102*a*, 102*b*, 102*c* than at the inner surface 86 of the overcap top. The tube retaining surfaces 100*a*, 100*b*, 100*c* extend at substantially 90 degrees from the inner surface 86 of the top 78 while the inner surface 88 of the side 80 extends at substantially 90 degrees plus the angle A from the inner surface 86 of the overcap top.

It should be understood that it is within the contemplation of this invention to provide any combination of angles at which the tube retaining surfaces 100*a*, 100*b*, 100*c* and the inner surface 88 of the side 80 extends from the inner surface 86 of the overcap top wherein the distance between the surfaces 100*a*, 100*b*, 100*c* and the inner surface 88 of the side 80 is greater at the lower edges 102*a*, 102*b*, 102*c* than as the surfaces 100*a*, 100*b*, 100*c* and the inner surface 88 are closer to the inner surface 86 of the overcap top. The tube retaining surfaces 100*a*, 100*b*, 100*c* and the inner surface 88 diverge in a direction away from the inner surface 86 of the overcap top.

It should also be understood that while it is preferable for the surfaces 100*a*, 100*b*, 100*c* and the inner surface 88 to so diverge, it is within the contemplation of this invention that they can be parallel to each other or even converge with respect to each other. It is also within the contemplation of this invention that the tube retaining portions are formed integrally with the side of the overcap, for example where they extend upwardly toward the top of the overcap and terminating at the unattached lower edges.

The distance between the tube retaining surfaces 100*a*, 100*b*, 100*c* and the inner surface 88 of the side 80 is greater than the undeformed diameter D at the lower edges 102*a*, 102*b*, 102*c* respectively. The lower edges 102*a*, 102*b*, 102*c* of the internal tube retaining portions 94, 96, and 98 define the beginning of their respective lower portions 101*a*, 101*b*, 101*c* of their tube retaining surfaces. The lower portions 101*a*, 101*b*, 101*c* of the tube retaining surfaces are spaced from the inner side 88 of the overcap a distance greater than the undeformed diameter D. It should be understood that the lower portions 101*a*, 101*b*, 101*c* may extend upwardly from their respective lower edges 102*a*, 102*b*, 102*c* of the internal tube retaining portions 94, 96, and 98 a small distance so as to allow ready entry of the tube extension 50 into the space between the surfaces 100*a*, 100*b*, 100*c* and the inner surface 88 of the overcap.

The distance between the surfaces 100*a*, 100*b*, 100*c* and the inner surface 88 as they are closer to the inner surface 86 of the overcap top are less than the undeformed diameter D to hold the tube in an assembled position. The upper portions 105*a*, 105*b*, 105*c* of the tube retaining surfaces 100*a*, 100*b*, 100*c* are defined by the portion of the tube retaining surface that is spaced from the inner surface 88 a distance less than the undeformed diameter D. The upper portions 105*a*, 105*b*, 105*c* of the tube retaining surfaces 100*a*, 100*b*, 100*c* extend from the inner surface 86 of the overcap top to the lower portions 101*a*, 100*b*, 100*c* respectively and includes the portion of the tube retaining surfaces 100*a*, 100*b*, 100*c* respectively and inner surface 88 of the overcap side that contacts the tube extension 50 when in an assembled position 76.

To assemble the tube and the overcap, the tube 32 is positioned in an assembly position 104 in a perimeter to fit in the space between the surfaces 100*a*, 100*b*, 100*c* and the inner surface 88 and is positioned adjacent the lower edges 102*a*, 102*b*, 102*c* and the lower portions 101*a*, 101*b*, 101*c* respectively, of the tube retaining surfaces. The tube 32 may be positioned between the surfaces 100*a*, 100*b*, 100*c* and the inner surface 88 of the side 80 by urging the tube towards the overcap top. As the tube 32 is so moved, it is compressed from its undeformed diameter D to its deformed diameter E and frictional forces hold the tube in the space between the surfaces 100*a*, 100*b*, 100*c* and the inner surface 88 of the side 80.

When the tube is so positioned between the internal tube retaining portions and the side of the overcap, it is removably affixed to the overcap. By so removably affixing the tube to the overcap, an actuator and tube overcap assembly 10 is provided without the need for additional components, such as adhesives, mechanical fasteners or shrink sleeves or the like. Furthermore, this design and assembly process provides an actuator and tube overcap assembly 10 which may be assembled with automated equipment.

The overcap 34 is removably attached to the actuator 30 and is supported thereon. When the overcap 34 is so attached to the actuator 30, movement between the overcap and actuator is stabilized. The overcap 34 has actuator stabilizer portions 92*a*, 94*a*, 96*a*, and 98*a* formed integrally with the internal tube retaining portions 92, 94, 96, and 98 respectively. The stabilizer portions 92*a*, 94*a*, 96*a*, and 98*a* have stabilizer surfaces 92*b*, 94*b*, 96*b*, and 98*b*, respectively which contact the outer surface 106 of the actuator body 35. The outer surface 106 has upper and lower surfaces 108, 110 respectively, which are generally in alignment with the central axis 112 of the actuator with the upper surface 108 having a smaller periphery than the lower surface 110 as shown in FIGS. 3, 5–8. The upper and lower surfaces 108, 110 are interconnected with a radial surface 114 of the outer surface 106 which extends generally upwardly and away from the lower surface 110 to the upper surface 108. The stabilizer surfaces 92*b*, 94*b*, 96*b*, and 98*b* are formed to contact the outer surface 106 of the actuator body 35 when the overcap 34 is attached to the actuator 30. It should be understood that it is within the contemplation of this invention to alternatively form stabilizers with the side of the overcap 34 or with the actuator 30 to contact the overcap.

The overcap 34 also has interconnecting stabilizer portions 116, 118 which stabilize movement between both the overcap and actuator 30 and the internal tube retaining portions 92, 94, 96, and 98 as seen in FIG. 2 and 6. The interconnecting stabilizer portion 116 is formed integrally with the top 78 of the overcap and interconnects the tube retaining portions 92, 94. The interconnecting stabilizer portion 116 has a stabilizing surface 120 which contacts the radial surface 114 of the outer surface 106 of the actuator body 35.

The interconnecting stabilizer portion 118 is similarly formed, interconnecting the tube retaining portions 96, 98 and having a stabilizing surface which contacts the radial surface 114 of the actuator body 35. When the overcap 34 is mounted on the actuator 30, the stabilizer surfaces 92*b*, 94*b*, 96*b*, and 98*b*, 120 restrict and restrain relative movement of the overcap and actuator. It is within the contemplation of this invention that the outer surface 106 of the actuator body 35 may have a wide variety of configurations and that the stabilizer surfaces 92*b*, 94*b*, 96*b*, and 98*b*, 120 are formed to contact at least a portion of the outer surface of the actuator body. Is also within the contemplation of this invention to position the stabilizer surfaces 92*b*, 94*b*, 96*b*, and 98*b* so as to accommodate various configurations of the actuator body.

When the actuator and tube overcap assembly 10 of the present invention is assembled with the container 12 with automated machinery, a force is exerted on outer surface 84 the top 78 and the container 12 urging them together. The stabilizers 92*a*, 94*a*, 96*a*, 98*a* are formed integrally with the top of the overcap and their stabilizer surfaces 92*b*, 94*b*, 96*b*, and 98*b* are in contact with the actuator. The stabilizers transmit the force exerted on the top of the cap to the actuator and provide rigidity to the actuator and tube overcap assembly 10. Such rigidity in the direction of relative movement of the assembly 10 and the container 12 during assembly provides a more predictable distance of movement for the automated machinery. This predictability in the distance of movement allows automated machinery to be more accurately set and assures assembly of the actuator and tube overcap assembly 10 with the container 12. For example, if there is flexure between the overcap 34 and the actuator 30, the automated assembly machine must accommodate the range of flexure.

The overcap 34 is removably affixed to the actuator 30 with a latch device 122 which allows for attachment and detachment of the overcap from the actuator as shown in FIGS. 2–5. The latch device 122 includes a locking depression 124 in the lower attachment skirt 126 of the actuator body 35. The locking depression 124 has a locking surface 128. The latch device 122 also has a movable latch portion 130 formed integrally with inner surface 86 of the top 78 of the overcap and extending from the inner surface thereof and terminates in a retaining portion 132. The retaining portion has a locking surface 134 for engagement with the locking surface 128 of the actuator body 35. A chamfered surface 136 is provided on the unattached end 138 of the retaining portion 132.

When the actuator and overcap are moved from an unlatched position in which the retaining portion 132 is disengaged from the locking surface 128, to the latched position 139, the chamfered surface 136 contacts the outer surface 106 of the actuator to move the movable latch portion 130 along the outer surface of the actuator. When the locking surfaces 128, 134 of the actuator 30 and overcap 34 respectively are adjacent each other, the movable latch portion 130 moves radially inwardly so that the locking surfaces 128, 134 are in engagement and are in the locked or latched position 139. In the latched position 139 the overcap 34 is removably attached to the actuator 30.

The movable latch portion 130 has reinforcing members 140 formed integrally with the top 78 of the overcap and the movable latch portion 130. These reinforcing members 140 create resistance to movement of the movable latch portion 130 as it is moved along the outer surface 130 of the actuator body 35. These reinforcing members 140 operate to urge the locking surfaces 128, 134 into the locking position 139 so that they are in engagement with each other.

It should be understood that the size and number of the reinforcing members 140 are dependent on the amount of resistance desired to be created on the retaining portion 132. This amount of resistance must be sufficient to hold the overcap 34 and actuator 30 in the locked or latched position 139 even against incidental impacts yet not so much resistance so as to prohibit intentional removal of the overcap from the actuator. In the locking position 139, the overcap 34 and actuator 30 are releasably stabilized with each other with the stabilizer surfaces 92*b*, 94*b*, 96*b*, and 98*b*, 120 in contact with the outer surface 106 of the actuator body 35. Such a design holds the overcap and actuator in the locked or latched position 139 against incidental impacts.

The latch 122 also allows for disengagement of the actuator 30 and overcap 34 so that the overcap may be detached from the actuator. The overcap 34 is detached from the actuator 30 by relative movement of the overcap and actuator which deforms the latch 122, thereby allowing detachment of the actuator and overcap. Such relative movement may occur by bending the actuator and overcap so the locking surfaces 134, 128 are no longer in engagement with each other.

In the unattached position, the tube 32 may be removed from the overcap 34. The connector 68 may then be attached to a fitting on the destination of the pressurized material and pressurized material transferred from the pressurized container. Such a design also allows for automated assembly of the actuator and overcap without the need for other components.

The actuator and tube overcap assembly 10 of the present invention is particularly adapted for automated assembly thereof. As described above, the actuator 30 and the tube 32 may be assembled by automated equipment. After this assembly is completed, the actuator and tube assembly 142, shown in FIG. 3, may be assembled with the overcap 34 by an automated process.

To accomplish this assembly, the extension portion 50 of the tube 32 is positioned in the assembly position 104 in a perimeter to fit in the space between the surfaces 100, 100*a*, 100*b*, 100*c* and the inner surface 88 of the overcap 34. The tube is then held in that assembly position after wrapping the tube to that perimeter. The connector 68 is positioned above the radial surface 114 of the outer surface 106 of the actuator. The tube 32 is then positioned adjacent the lower edges 100, 102*a*, 102*b*, 102*c* of the tube retaining surfaces 100, 100*a*, 100*b*, 100*c* respectively. The actuator 30 is positioned in axial alignment with the overcap 34 so the outer surface 106 of the actuator body 35 is in alignment with the stabilizer surfaces 92*b*, 94*b*, 96*b*, and 98*b*, 120. In addition, the latch device 122 is in the unlatched position in which the retaining portion 132 is disengaged from the locking surface 128 and the chamfered surface 136 of the latch device is spaced from and in alignment with the outer surface 106 of the actuator and the locking depression 124 of the actuator.

The tube 32 is then moved toward the top of the overcap to the assembled position 76. As the tube is so moved, it is compressed from its undeformed diameter D to its deformed diameter E and frictional forces hold the tube in the space between the surfaces 100, 100*a*, 100*b*, 100*c* in the overcap surface 88. In the assembled position 76 the extension portion 50 of said tube 52 is positioned substantially above the valve portion 38 of the actuator 30 and substantially between the valve portion and the top 78 of said overcap 34.

The actuator 30 is moved toward the top 78 of the overcap 34 to the assembled position 76. As the actuator is so moved, the locking surfaces 128, 134 of the actuator 30 and overcap 34 respectively, are positioned adjacent each other and the movable latch portion 130 moves radially inwardly so that the locking surfaces 128, 134 are in engagement and in the locking position 139. The movement of the tube and actuator toward the top of the overcap may be performed either sequentially or simultaneously.

The present invention provides a method for assembling an actuator and tube overcap assembly by attaching the inlet end of the tube to the outlet of the actuator, positioning the tube in the assembly position within a perimeter to fit between the space between the tube retaining surfaces and the side of said overcap, holding the tube in the assembly position, and positioning the tube between the side and the tube retaining surfaces of the overcap. The step of positioning the tube between the side and the tube retaining surfaces of the overcap includes the step of deforming the tube by contact between the side and the tube retaining surfaces of the overcap. The step of removably affixing the actuator to the overcap is performed after the step of positioning the tube in the assembly position and preferably is performed simultaneously with the step of positioning the tube between the side the tube retaining surfaces of the overcap but may be performed either before or after the step of positioning the tube between the side of the tube retaining surfaces of the overcap.

Accordingly the actuator 30 is removably affixed to the overcap 34. In the locked position 139, the overcap 34 and actuator 30 are releasably stabilized with each other and the stabilizer surfaces 92*b*, 94*b*, 96*b*, and 98*b*, 120 are in contact with the outer surface 106 of the actuator body 35. In the affixed or locking position 139, the tube extension extension portion 50 is positioned substantially above the valve portion 38 of the actuator 30. It should be understood that it is within the contemplation of this invention to position the tube 32 at any position with respect to the actuator 30 and the overcap 34 and in the space between the surfaces 100, 100*a*, 100*b*, 100*c*, and the inner surface 88 of the overcap side 80.

Figure 9:
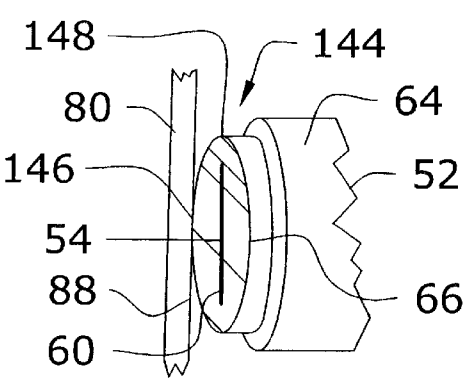
FIG. 9 is a sectional view of the actuator and tube overcap assembly shown in FIG. 4 and take along lines 9—9 to the thereof.

As shown in FIGS. 4 and 9, the actuator and tube overcap assembly 10 of the present invention provides a secondary valve 144, in addition to the valve portion 38 of the actuator 30, to seal the pressurized contents in the container of 12 when the actuator and tube overcap assembly is in the assembled position 76. This secondary valve 144 is provided by the tube 32 which can be deformed to seal the passageway 54. When the tube 32 is disassembled from the overcap 34 for use, the tube recovers from its deformed position 146 and allows the pressurized material to flow therethrough. It has been found that a tube 32 having a particular combination of physical characteristics will achieve this feature and also meet the other requirements of a tube used with the assembly 10.

To achieve this secondary valve feature, the inner side 88 of the side 80 of the overcap is positioned adjacent the outlet 44 of the actuator 30 a distance that the substantially or completely closes the fluid passageway 54 of the tube positioned between the overcap side and the outlet 52 of the actuator. When the actuator and tube assembly 142 is assembled with the overcap 34, the valve portion 148 of the tube 32 is deformed so that its outer surface 66 contacts the inner side 88 of the overcap. As the actuator and tube assembly 142 is moved to the assembled position 76, the side 80 of the overcap being at an angle as described above, continues to deformed the valve portion 148 of the tube so that the inner wall 60 defining the passageway 54 in the tube is sealed in its deformed position 146. In the deformed position 146, pressurized material is restricted from flowing through the tube.

The distance that the inner side 88 of the side 80 is spaced from the outlet 52 of the actuator may be modified for the particular tube being used, such as tubes having different diameters and tube thicknesses. It should also be understood that for purposes of describing the deformation of the tube to the deformed position 146, the term overcap includes other devices that are used to deformed the valve portion 148 of the tube so that the inner walls 60 defining the passageway 54 in the tube are sealed or substantially sealed in the deforming position. It is also within the compilation of this invention that such other devices could be attached to either the actuator 30, pressurized canister 12 or other component of the assembled product.

When it is desirable to use the tube 32, it is disassembled from the overcap 34 and extended for use. When so disassembled it is desirable that the valve portion 148 no longer be deformed and allow pressurized material to flow therethrough. A tube having these material characteristics is sufficiently flexible to seal when deformed by the overcap which forces the tube against the actuator outlet. Is within the contemplation of this invention for the overcap to force the tube against another component so that this secondary valve 144 is accordingly provided. When used in connection with the secondary valve 144, the term outlet of the actuator includes such other components. In addition, when such a tube is disassembled from the overcap it allows pressurized material to flow therethrough and also has sufficient strength to handle the pressure of the pressurized material and sufficient flexure to attach to the actuator. The tube must be made from a material that has recovery characteristics that allow material to flow therethrough when removed from the overcap.

It has been found that plastic material having the following material characteristics achieves the above described features of providing a secondary valve 144 and is also capable of handling the pressures exerted thereon when the material is discharged from the container 12. The thermoplastic tube material having this combination of material characteristics has a specific gravity from between about 0.98 glcc and 1.21 g/cc using the ASTM D 792 test method, a durometer hardness of from between about 50 Shore A to 55 Shore D using the ASTM D 2240 test method, and ultimate elongation (%@Break) of from between about 250% to 2,000% using the ASTM D 412 test method, a compression set (after 22 hours@approximately 75 degrees Fahrenheit) of from between about 2% to 38% using the ASTM D 395 method B test method and a low temperature brittle point of from between about −22 degrees Fahrenheit and −110 degrees Fahrenheit using the ASTM D 746 test method. One such thermoplastic material that may be formulated to meet these physical characteristics is polyurethane.

A tube having this combination of material characteristics is sufficiently flexible to seal when deformed by the overcap forcing the tube against the actuator outlet. In addition, when such a tube is disassembled from the overcap, it allows pressurized material to flow therethrough and has sufficient strength to handle the pressure of the pressurized material.

It has been found that a material having these material characteristics may also be used in other actuator and tube overcap assembly designs in which the tube is bent. In the past, designs have recognized the problem created by kinking the tube and have taken various steps to avoid that kinking.

Figure 8:
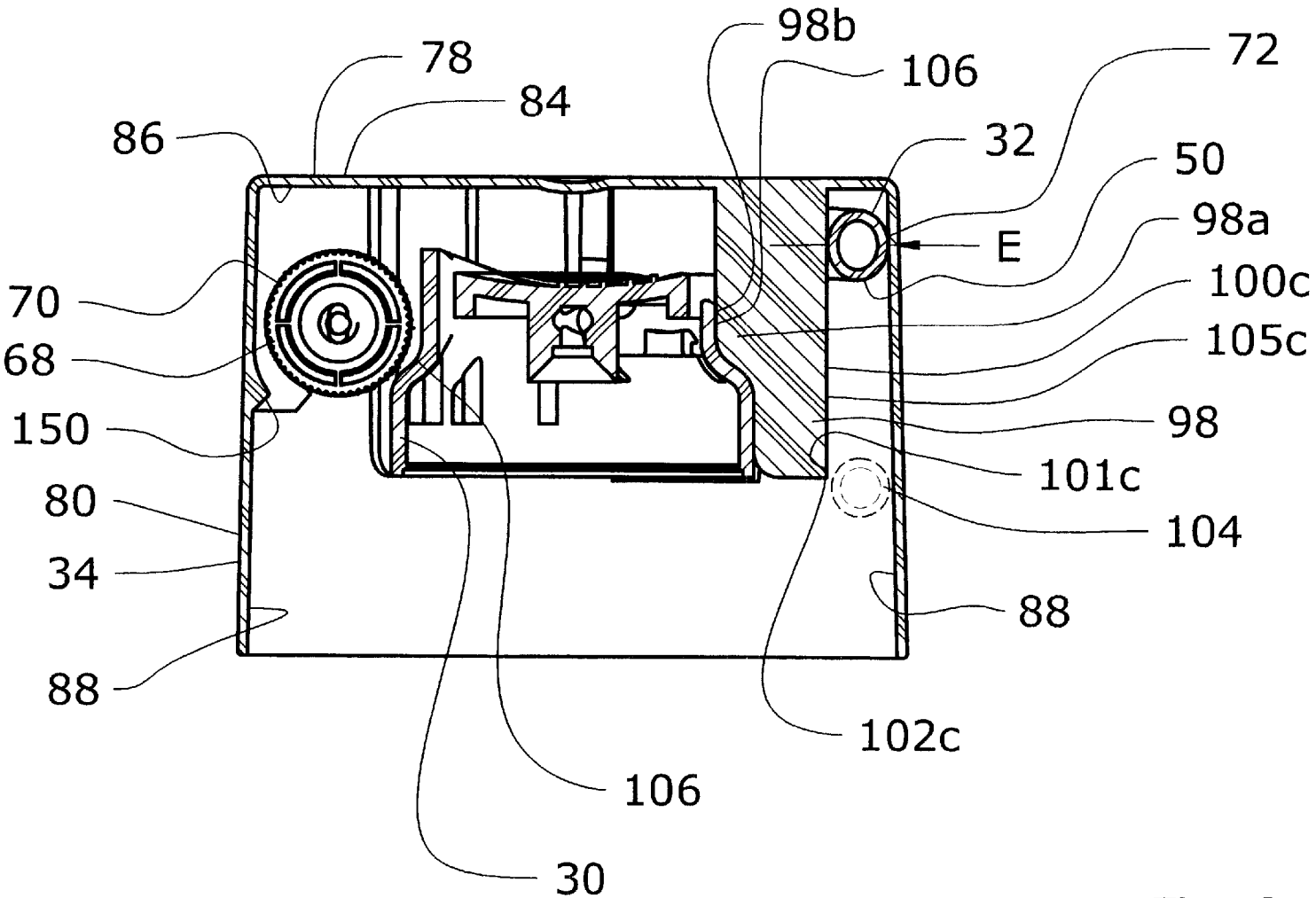
FIG. 8 is a sectional view of the actuator and tube overcap assembly shown in FIG. 4 and take along lines 8—8 to the thereof.

The present invention provides for removably securing the connector 68 to either the overcap 34 or the actuator 30 without additional components. In the assembled position 76, the tube extension portion 50 and the connector 68 are positioned substantially above the valve portion 38 of the actuator 30 as seen in FIG. 8. As described above, the connector 68 has an outer periphery 70 greater than the outer periphery 72 of the tube 32. A tube holding protrusion 150 is formed on the inner surface 88 of the side 80 of the overcap and extends towards the actuator 30 to contact the outer periphery 70 of the connector 68. The outer periphery 70 of the connector 68 also contacts outer surface 106 of the actuator body 35.

It should be understood that it is within the contemplation of this invention to form the tube holding protrusion on the tube retaining surfaces 100, 100*a*, 100*b*, or 100*c*. It should also be understood that it is within the contemplation of this invention that the outer periphery 70 of the connector 68 may be held in position by contact with the inner surface 88 and the outer surface 106 of the actuator body 35 without a protrusion 150. In this case, the space between the inner surface 88 and the outer surface 106 where the connector is positioned is less than the size of the outer periphery 70 of the connector 68. Accordingly, the connector 68 is releasably secured between the actuator 30 and the side 88 when the actuator and tube overcap assembly is in the assembled position. This design provides a unitary assembly 10 which can be handled by automatic equipment for assembly to the pressurized container 12.

Figure 5:
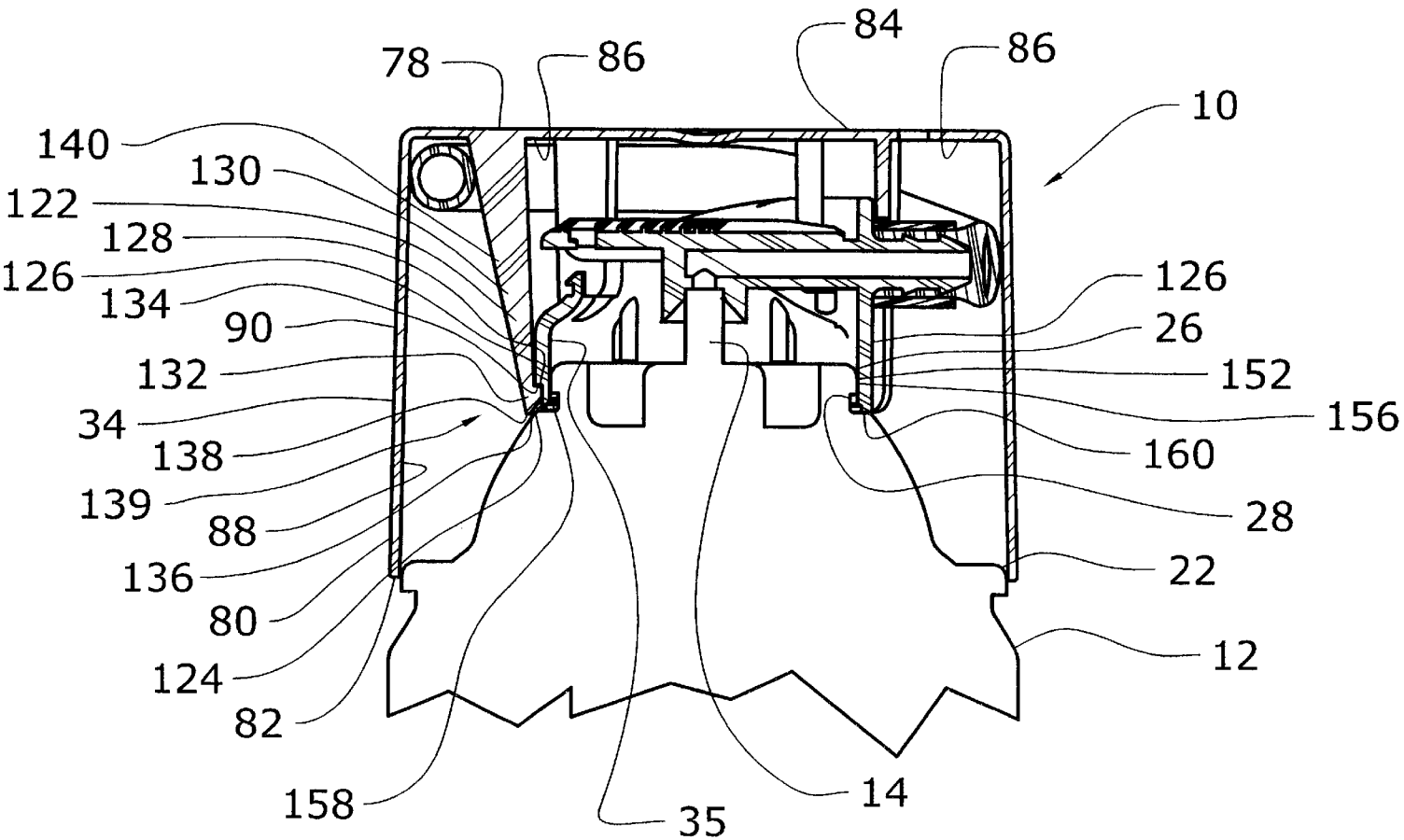
FIG. 5 is a sectional view of the actuator and tube overcap assembly shown in FIG. 4 and take along lines 5—5 thereof.

The assembly of the actuator and tube overcap assembly 10 to the pressurized container 12 is dependent on the connection between the assembly 10 and container 12. The embodiment disclosed in FIGS. 1–9 provides a container 12 that has the upper rim 22 and the top rim 26, as seen in FIGS. 2, 3 and 5. The top rim 26 has a generally circular side portion 152 with the radially inward depression 28 formed therein. The upstanding valve 14 in the container 12 is centrally located with respect to the top rim 26.

The cylindrical body 35 of the actuator 30 has a lower attachment skirt 126 having an inner surface 156. The inner surface 156 has a circumference slightly larger than the circumference of the circular side portion 152 and is formed to mate therewith. The inner surface 156 of the actuator's attachment skirt 126 is formed to be received by the side portion 152 of the rim 26. The attachment skirt 126 of the actuator has an inwardly extending flange 158 adjacent the bottom edge 160 for attaching the actuator 30 to the container 12.

The actuator and tube assembly 10 of the present invention is particularly adapted to the assembled with the container 12 with automatic machinery. To connect the actuator and tube assembly 10 to the container 12, the assembly 10 is oriented in a predetermined position that allows for automatic assembly with the container 12. As can be seen, the uniform shape of the assembly 10 readily allows for such automated orientation. Likewise, the container 12 may also be oriented by automated equipment.

The inner surface 156 of the actuators attachment skirt 126 is then aligned with the side portion 152 of the top rim 26, and the valve 14 of the container 12 is aligned with the inlet 42 of the valve portion 38. A force is then exerted on the top 78 of the overcap 34 and the bottom 20 of the pressurized container 12. This force is transmitted from the top 78 to the actuator 30 by the stabilizer surfaces 92*b*, 94*b*, 96*b*, and 98*b*, and 120 which are in contact with the outer surface 106 of the actuator body 35. The stabilizer portions and their complementary surfaces provide an overcap assembly 10 that effectively transmit the forces exerted on the top of the overcap to the actuator.

Due to the flexibility of the lower attachment skirt 126, the inwardly extending flange 158 expands when it is pressed onto the top rim 26. The assembly 10 moves toward the container 12 and the inwardly extending flange 158 slides across the side portion 152 of the top rim 26 until it is received in the depression 28 thereof. When the flange 158 is so engaged by the depression 28, the assembly 10 is secured to the container 12. When the assembly 10 and canister 12 are assembled, the bottom edge 82 of the overcap is adjacent the upper rim 22 and is spaced therefrom. It is within the contemplation of this invention that the bottom edge 82 of the overcap may also be in contact with or attached to the upper rim 22 as will hereinafter be more fully described. It should be understood that the actuator may be attached to the container with a wide variety of connector designs.

The finished product resulting from the assembly of the actuator and tube overcap assembly 10 and the container 12 has a uniform configuration that can easily automatically packed, efficiently stored on shelves and does not get tangled up with other objects in a vehicle's trunk and damage the connection between the tube and the actuator or the actuator and the pressurized container.

The actuator and tube overcap assembly of the present invention allows for the use of tubes of differing lengths so that it can be used in a variety of different applications such as tire inflator products, air conditioning recharge products and other aerosol applications. The present invention provides an actuator and tube assembly 10 in which the tube can be of differing lengths depending on the specific application. By changing the height of the overcap or the outside periphery of the overcap, tubes of widely varying lengths can be removably attached to the overcap. For example if the overcap height is increased, additional coils or partial coils of the tube can be secured by the overcap as described above.

Figure 10:
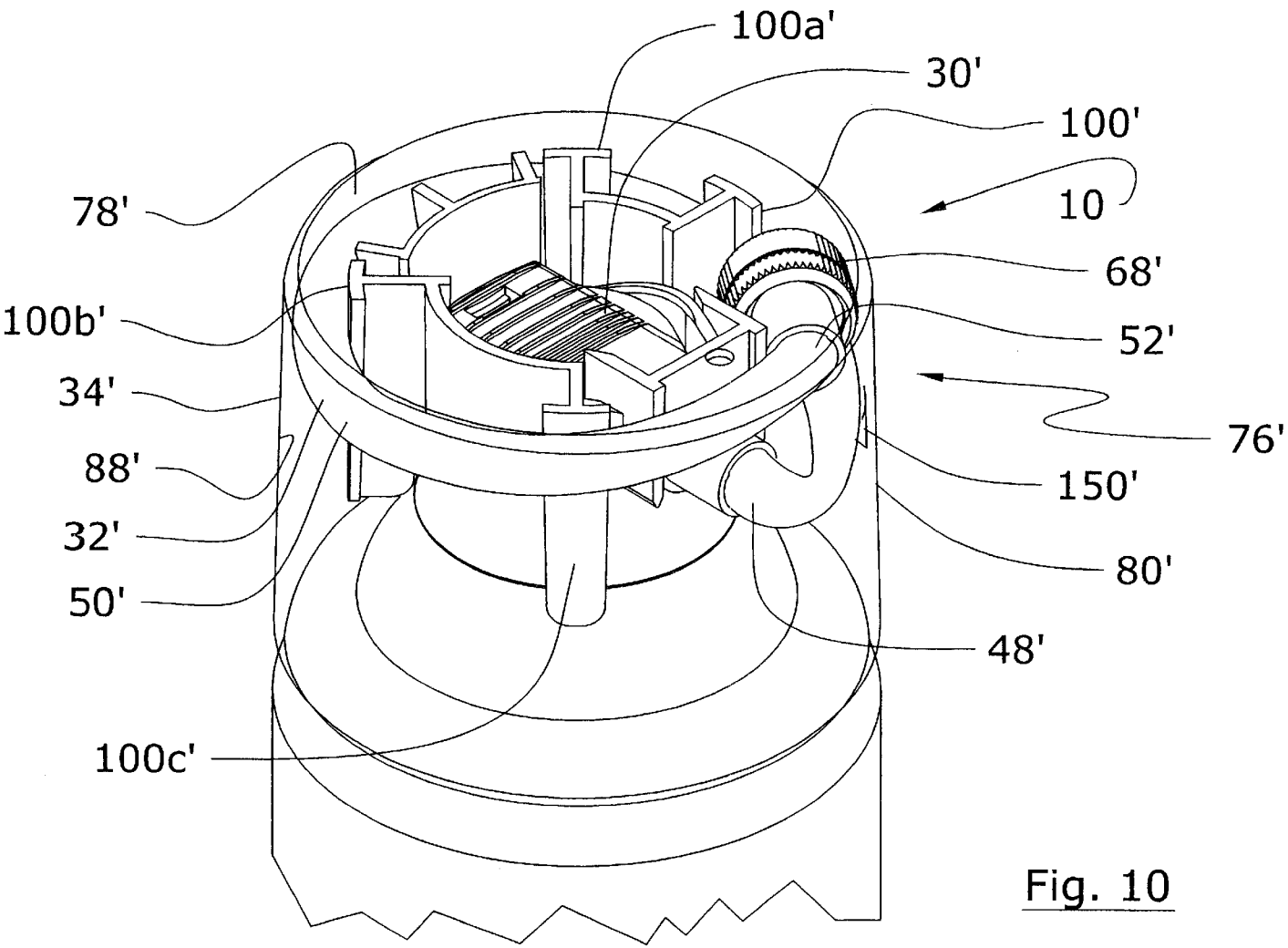
FIG. 10 is an enlarged perspective view of a second embodiment of the actuator and tube overcap assembly of present invention.

Another embodiment of the actuator and tube overcap assembly of the present invention is shown in FIG. 10. For ease of description, the actuator and tube overcap assembly 10' is numbered with the numerals the same as used in connection with the actuator and tube overcap assembly 10 to denote common parts where appropriate and followed by a prime (') mark to denote the actuator and tube overcap assembly 10'.

The present invention provides an actuator and tube overcap assembly which allows the tube to be wrapped in opposite directions with the connector above or below the tube. The actuator and tube overcap assembly 10' provides a tube 32' that is wrapped in the opposite direction, counter clockwise as viewed from the top 78' of the overshell 34', than the tube 32 which is wrapped in a clockwise direction as shown in FIG. 1.

The actuator and tube assembly 10' positions the connector 68' above the tube 32'. The tube 32' has an inlet end 48', extension portion 50' and outlet end 52'. The inlet end 48' of the tube is fluidically connected to the outlet 44' of the actuator 30'. In the assembled position 76', the extension portion 50' is secured in the assembled position by being positioned between and in contact with the tube retaining surfaces 100', 100*a*', 100*b*', 100*c*' and the inner surface 88' of the side 80' of the overcap 34'. The outlet end 52' has the connector 68' attached thereto.

In the actuator and tube overcap assembly 10', the connector 68' is positioned above the extension portion 50' of the tube and adjacent the top 78' of the overshell 34' when in the assembled position 76'. The connector 68' is held in the assembled position 76' by the extension portion 50' of the tube. The extension portion 50' of the tube is held in the assembled position by the frictional forces exerted on the extension portion by the retaining surfaces 100', 100*a*', 100*b*', 100*c*' and the inner surface 88' of the overcap 34' as described above in connection with the assembly 10.

A protrusion 150' is formed in the overcap 34' and extends from the inner surface 88' thereof The protrusion 150' is formed to contact the extension portion 50' of the tube so that stays in the assembled position 76'. It should be understood that it is within the contemplation of this invention that the frictional forces exerted by the retaining surfaces 100', 100*a*', 100*b*', 100*c*' and the inner surface 88' may hold the tube 32' and connector 68' in place.

Figure 11:
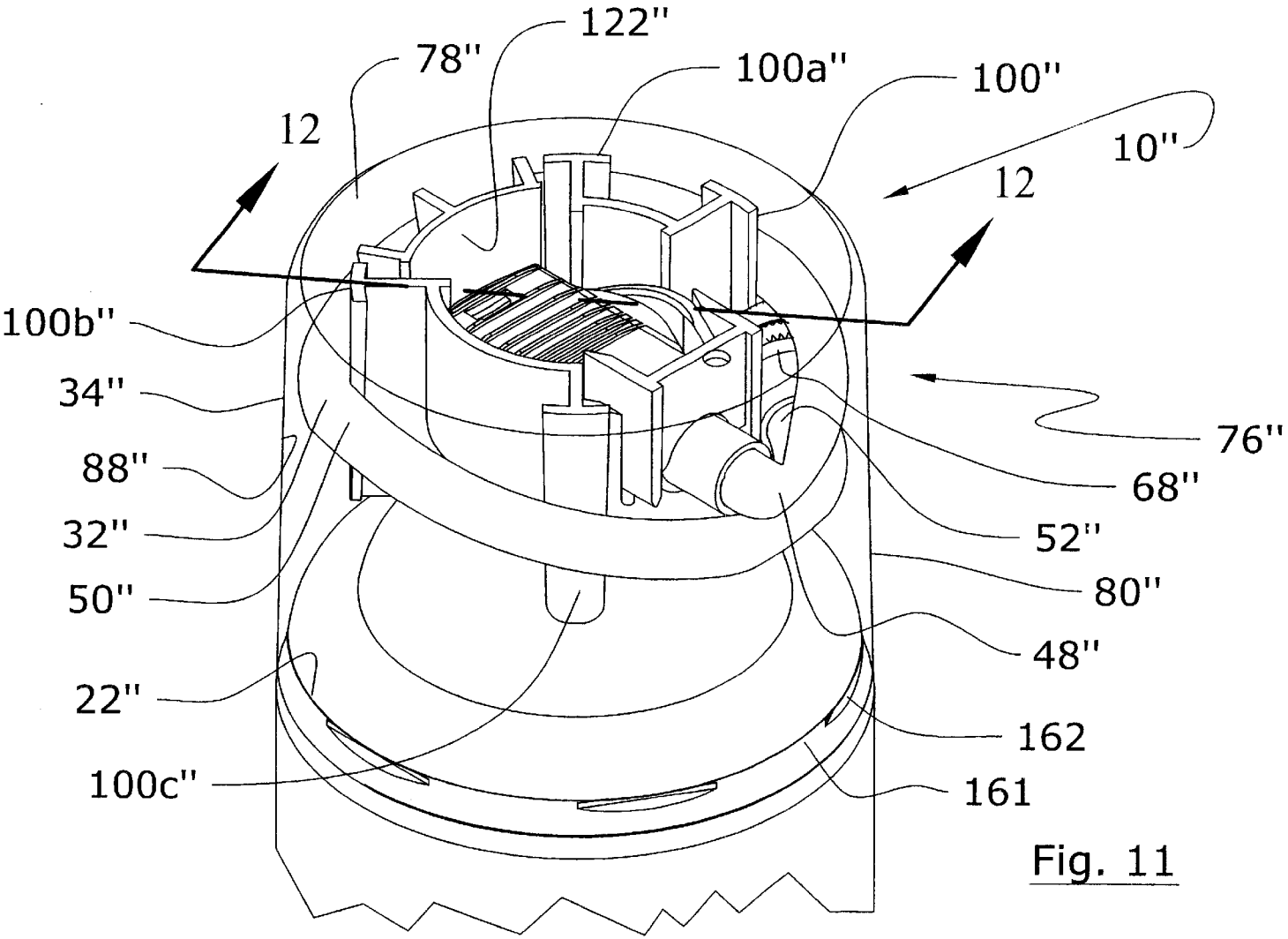
FIG. 11 is an enlarged perspective view of a second embodiment of the actuator and tube overcap assembly of present invention.
Figure 12:
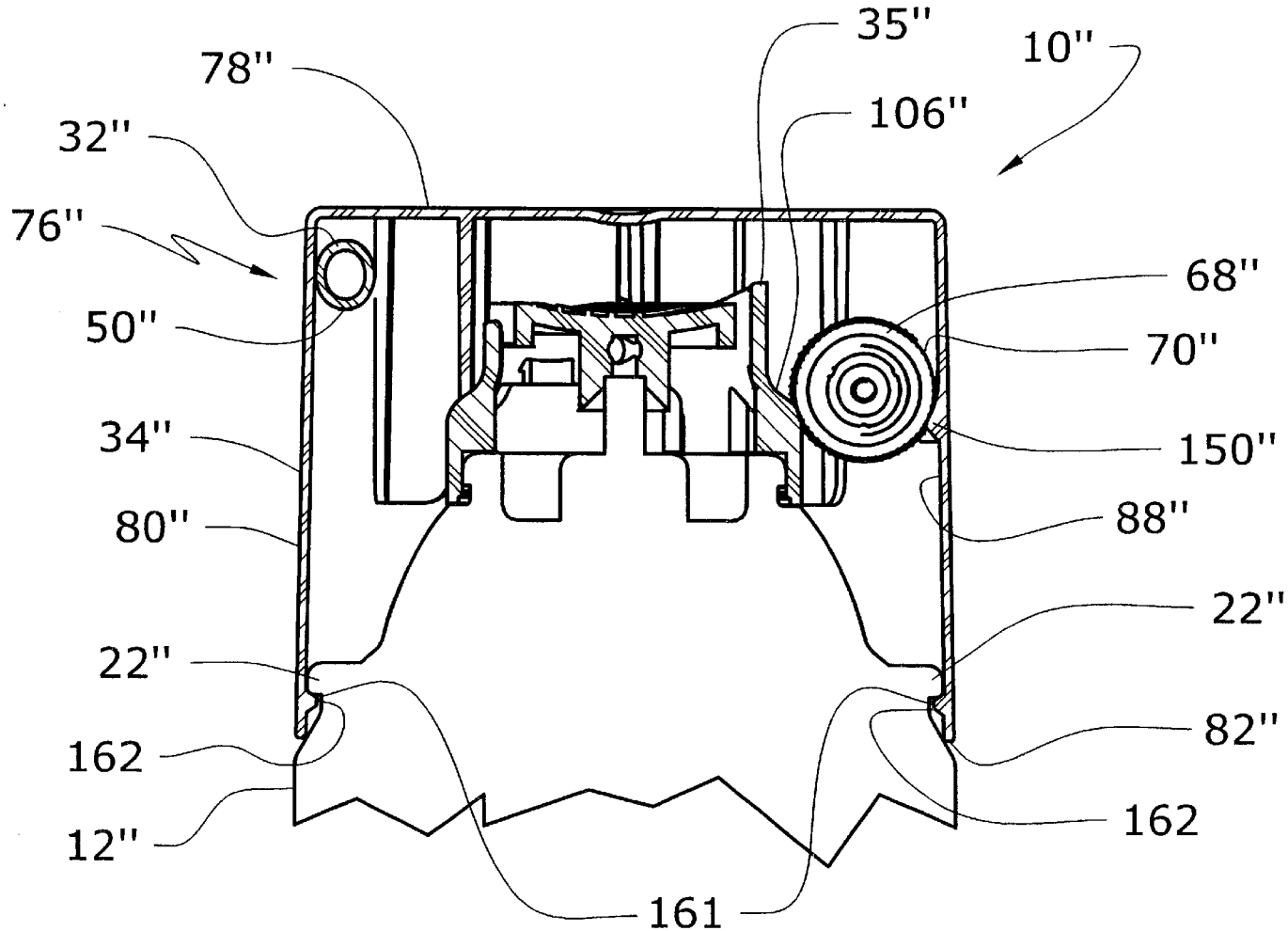
FIG. 12 is a sectional view of the second embodiment of the actuator and tube overcap assembly shown in FIG. 11 and take along lines 12—12 thereof.

Another embodiment of the actuator and tube overcap assembly of the present invention is shown in FIGS. 11–12. For ease of description, the actuator and tube overcap assembly 10" is numbered with the numerals the same as used in connection with the actuator and tube overcap assembly 10 to denote common parts where appropriate and followed by a double prime (") mark to denote the actuator and tube overcap assembly 10".

As seen in FIGS. 11 and 12, the present invention provides an actuator and tube overcap assembly 10" which provides a tube 32" that is wrapped in the counter clockwise direction as viewed from the top 78" of the overcap 34". The connector 68" is positioned below the tube 32". The tube 32" has an inlet end 48", extension portion 50" and outlet end 52". The inlet end 48" of the tube is fluidically connected to the outlet 44" of the actuator 30". In the assembled position 76", the extension portion 50" is secured in the assembled position by being positioned between and in contact with the tube retaining surfaces 100", 100*a*", 100*b*", 100*c*" and the inner surface 88" of the overcap 34". The outlet end 52" has the connector 68" attached thereto.

In the actuator and tube overcap assembly 10", the connector 68" is positioned below with the extension portion 50" of the tube. The extension portion 50" of the tube is positioned between the connector 68" and the top 78" of the overshell 34" when in the assembled position 76". The extension portion 50" of the tube is held in the assembled position by the frictional forces exerted on the extension portion by the retaining surfaces 100", 100*a*", 100*b*", 100*c*" and the inner surface 88" of the side 80" of the overcap 34" as described above in connection with the assembly 10.

A protrusion 150" is formed in the overcap 34" and extends from the inner surface 88" thereof The protrusion 150" is formed to contact with the outer periphery 70" of the connector 68" so that the connector is secured in the assembled position 76". The outer periphery 70" of the connector 68" is also in contact with the outer surface 106" of the actuator body 35". By so securing the connector 68" in the assembled position 76", the tube extension portion 50" is also held in the assembled position 76".

In the embodiment shown in FIGS. 11 and 12, the overcap 34" of the actuator and tube overcap assembly 10" has a top 78" and a side 80" which terminates in the bottom edge 82".

Container engaging protrusions 162 are provided adjacent the bottom edge 82" for engaging the depression 161of the upper rim 22" of the container 12" and provide an additional mechanism to hold the overcap 34" to the container.

While the latch device 122" is shown in FIG. 11, it is within the contemplation of this invention to hold the actuator 30" in the assembled position 76" by securing the connector and tube to the overshell with the retaining surfaces and the inner surfaces of the overcap and the protrusion as described above. In such a design, the actuator is removably attached to the overcap with a friction fit therebetween. For example, the stabilizer would frictionally engage the actuator. In such a design, the overcap is removably attached to the pressurized container 12 by the container engaging protrusions 162 engaging the upper rim 22".

The invention has been described with reference to the preferred embodiment. Obviously, modifications and alterations will occur to others upon reading and understanding the specification. It is our intention to include all modifications and alterations in so far as they are within the scope of the appended claims or equivalents thereof.

Having described our invention, we claim:

1. An actuator and tube overcap assembly for installation onto a pressurized container, said assembly comprising:

an actuator having an inlet and an outlet, a flexible discharge tube having an inlet end fluidically connected to said outlet of said actuator, an extension portion extending from said inlet end of said tube and a fluid passageway therethrough, and an overcap removably affixed to said actuator, said overcap having a top and a side extending at an angle from said top, each of said top and said side having an inner surface, said overcap having at least one tube retaining portion extending from at least one of said top and said side, said one tube retaining portion having an unattached end, said one tube retaining portion having a tube retaining surface, said tube retaining surface extending from said unattached end and spaced from said inner surface of said side, said extension portion of said tube positioned between said tube retaining surface and said inner surface of said side of said overcap.

2. An actuator and tube overcap assembly as claimed in claim 1 in which said side contacts said tube and is positioned adjacent said outlet of said actuator a distance that substantially closes said fluid passageway of said tube positioned between said side and said outlet of said actuator.

3. An actuator and tube overcap assembly as claimed in claim 1 in which said inner surface of said side of said overcap and said tube retaining surface diverge as they extend away from said unattached end of said one tube retaining portion.

4. An actuator and tube overcap assembly as claimed in claim 1 in which said inner side of said overcap is at an angle greater than 90 degrees from said inner surface of said top.

5. An actuator and tube overcap assembly as claimed in claim 1 in which said extension portion of said flexible discharge tube has an undeformed diameter, at least a portion of said tube retaining surface spaced from said inner surface of said side a distance less than said undeformed diameter of said extension portion of said tube.

6. An actuator and tube overcap assembly as claimed in claim 5 in which said tube retaining surface has an upper portion, said upper portion spaced from said inner surface of said side a distance less than said undeformed diameter of said extension portion of said tube.

7. An actuator and tube overcap assembly as claimed in claim 5 in which said tube retaining surface has a lower portion, said lower portion adjacent said unattached end of said one tube retaining portion and spaced from said inner surface of said side a distance greater than said undeformed diameter of said extension portion of said tube.

8. An actuator and tube overcap assembly as claimed in claim 1 in which said one internal tube retaining portion includes a plurality of internal tube retaining portions.

9. An actuator and tube overcap assembly as claimed in claim 1 in which said actuator has a valve portion, said extension portion of said tube positioned substantially above said valve portion of said actuator and substantially between said valve portion and said top of said overcap.

10. An actuator and tube overcap assembly as claimed in claim 1 including a connector and in which said tube has an outlet end opposite said inlet end, said connector attached to said outlet end of said tube, said connector positioned above said tube extension.

11. An actuator and tube overcap assembly as claimed in claim 1 including a connector and in which said tube has an outlet end opposite said inlet end, said connector attached to said outlet end of said tube, said connector positioned below said tube extension.

12. An actuator and tube overcap assembly as claimed in claim 1 wherein said side extends from said top of said overcap and terminates at a bottom edge, said overcap having a tube holding protrusion extending from one of said tube retaining surface and said inner surface of said side and spaced between said bottom edge of said side and said top of said overcap.

13. An actuator and tube overcap assembly as claimed in claim 12 in which said tube has an outlet end opposite said inlet end, said actuator and tube overcap assembly including a connector attached to said outlet end of said tube, said connector positioned between said tube holding protrusion and said top of said overcap.

14. An actuator and tube overcap assembly as claimed in claim 12 in which said tube holding protrusion contacts said extension portion of said tube.

15. An actuator and tube overcap assembly as claimed in claim 1 wherein said tube is made from a thermoplastic material having a specific gravity from between about 0.98 g/cc and 1.21 g/cc using the ASTM D 792 test method, a durometer hardness of from between about 50 Shore A to 55 Shore D using the ASTM D 2240 test method, and ultimate elongation (% @Break) of from between about 250% to 2,000% using the ASTM D 412 test method, a compression set (after 22 hours@approximately 75 degrees Fahrenheit) of from between about 2% to 38% using the ASTM D 395 method B test method and a low temperature brittle point of from between about −22 degrees Fahrenheit and −110 degrees Fahrenheit using the ASTM D 746 test method.

16. An actuator and tube overcap assembly as claimed in claim 1 having a latch device for removably affixing said actuator to said overcap, said latch device having a locking depression, said locking depression on one of said actuator and said overcap having a locking surface, said latch device having a latch on the other of said actuator and said overcap, said latch movable between an unlatched and latched position, said latch having a retaining portion engaging said locking surface when in said latched position and movable to said unlatched position in which said retaining portion is disengaged from said locking surface.

17. An actuator and tube overcap assembly as claimed in claim 1 in which said overcap has at least one stabilizer extending from one of said inner surfaces of said overcap, said stabilizer and having a stabilizing surface contacting said actuator.

18. An actuator and tube overcap assembly as claimed in claim 1 in which one of said top of said overcap and said actuator has at least one stabilizer extending to the other of said top of said overcap and said actuator, said one stabilizer having a stabilizing surface contacting said other of said top of said overcap and said actuator.

19. An actuator and tube overcap assembly as claimed in claim 18 in which one of said top of said overcap and said actuator has a plurality of stabilizers extending to the other of said top of said overcap and said actuator, said stabilizers having a stabilizing surface contacting said other of said top of said overcap and said actuator, said one of said top of said overcap and said actuator having an interconnecting stabilizer formed integrally with two of said stabilizers and extending therebetween, said interconnecting stabilizer having a stabilizing surface contacting said other of said top of said overcap and said actuator.

20. An actuator and tube overcap assembly as claimed in claim 1 in which said actuator and tube overcap assembly is configured to allow the operable assembly of said actuator and tube overcap assembly with the container by automated machinery.

21. An actuator and tube overcap assembly for installation onto a pressurized container, said assembly comprising:

an actuator having an inlet and an outlet, a flexible discharge tube having an inlet end fluidically connected to said outlet of said actuator and an extension portion extending from said inlet end of said tube and a fluid passageway therethrough, an overcap removably affixed to said actuator, said overcap having a top and a side extending at an angle from said top to a bottom edge, one of said top and said actuator has at least one stabilizer extending to the other of said top and said actuator, said one stabilizer having a stabilizing surface contacting said other of said top and said actuator.

22. An actuator and tube overcap assembly as claimed in claim 21 in which said one stabilizer includes a plurality of stabilizers.

23. An actuator and tube overcap assembly as claimed in claim 22 in which one of said top of said overcap and said actuator has a plurality of stabilizers extending to the other of said top of said overcap and said actuator, said stabilizers having stabilizing surfaces contacting said other of said top of said overcap and said actuator, said one of said top of said overcap and said actuator having an interconnecting stabilizer formed integrally with two of said stabilizers and extending therebetween, said interconnecting stabilizer having a stabilizing surface contacting said other of said top of said overcap and said actuator.

24. An actuator and tube overcap assembly as claimed in claim 22 in which each of said top and said side has an inner surface, said overcap having at least one tube retaining portion extending from at least one of said top and said side, said one tube retaining portion having an unattached end, said one tube retaining portion having a tube retaining surface, said tube retaining surface extending from said unattached end and spaced from said inner surface of said side, said extension portion of said tube positioned between said tube retaining surface and said inner surface of said side of said overcap.

25. An actuator and tube overcap assembly as claimed in claim 24 in which said extension portion of said flexible discharge tube has an undeformed diameter, at least a portion of said tube retaining surface spaced from said inner surface of said side a distance less than said undeformed diameter of said extension portion of said tube.

26. An actuator and tube overcap assembly as claimed in claim 24 in which said tube retaining surface has an upper portion, said upper portion spaced from said inner surface of said side a distance less than said undeformed diameter of said extension portion of said tube.

27. An actuator and tube overcap assembly as claimed in claim 24 in which said tube retaining surface has a lower portion, said lower portion adjacent said unattached end of said one tube retaining portion and spaced from said inner surface of said side a distance greater than said undeformed diameter of said extension portion of said tube.

28. An actuator and tube overcap assembly as claimed in claim 24 in which said inner surface of said side of said overcap and said tube retaining surface diverge as they extend away from said unattached end of said one tube retaining portion.

29. An actuator and tube overcap assembly as claimed in claim 24 in which said inner side of said overcap is at an angle greater than 90 degrees from said inner surface of said top.

30. An actuator and tube overcap assembly as claimed in claim 24 wherein said side extends from said top of said overcap and terminates at a bottom edge, said overcap having a tube holding protrusion extending from one of said tube retaining surface and said inner surface of said side and spaced between said bottom edge of said side and said top of said overcap.

31. An actuator and tube overcap assembly as claimed in claim 30 in which said tube has an outlet end opposite said inlet end, said actuator and tube overcap assembly including a connector attached to said outlet end of said tube, said connector positioned between said tube holding protrusion and said top of said overcap.

32. An actuator and tube overcap assembly as claimed in claim 30 in which said tube holding protrusion contacts said extension portion of said tube.

33. An actuator and tube overcap assembly as claimed in claim 21 in which said side contacts said tube and is positioned adjacent said outlet of said actuator a distance that substantially closes said fluid passageway of said tube positioned between said side and said outlet of said actuator.

34. An actuator and tube overcap assembly as claimed in claim 21 wherein said tube is made from a thermoplastic material having a specific gravity from between about 0.98 g/cc and 1.21 g/cc using the ASTM D 792 test method, a durometer hardness of from between about 50 Shore A to 55 Shore D using the ASTM D 2240 test method, and ultimate elongation (%@Break) of from between about 250% to 2,000% using the ASTM D 412 test method, a compression set (after 22 hours@approximately 75 degrees Fahrenheit) of from between about 2% to 38% using the ASTM D 395 method B test method and a low temperature brittle point of from between about −22 degrees Fahrenheit and −110 degrees Fahrenheit using the ASTM D 746 test method.

35. An actuator and tube overcap assembly as claimed in claim 21 having a latch device for removably affixing said actuator to said overcap, said latch device having a locking depression, said locking depression on one of said actuator and said overcap having a locking surface, said latch device having a latch on the other of said actuator and said overcap, said latch movable between an unlatched and latched position, said latch having a retaining portion engaging said locking surface when in said latched position and movable to said unlatched position in which said retaining portion is disengaged from said locking surface.

36. An actuator and tube overcap assembly as claimed in claim 21 in which said actuator and tube overcap assembly is configured to allow the operable assembly of said actuator and tube overcap assembly with the container by automated machinery.

37. An actuator and tube overcap assembly for installation onto a pressurized container, said assembly comprising:

an actuator having an inlet and an outlet, a flexible discharge tube having an inlet end fluidically connected to said outlet of said actuator and an extension portion extending from said inlet end of said tube and a fluid passageway therethrough, and an overcap removably affixed to said actuator, said overcap having a side in contact with said tube and positioned adjacent said outlet of said actuator a distance that substantially closes said fluid passageway of said tube positioned between said side and said outlet of said actuator.

38. An actuator and tube overcap assembly as claimed in claim 37 wherein said tube is made from a thermoplastic material having a specific gravity from between about 0.98 g/cc and 1.21 g/cc using the ASTM D 792 test method, a durometer hardness of from between about 50 Shore A to 55 Shore D using the ASTM D 2240 test method, and ultimate elongation (%@Break) of from between about 250% to 2,000% using the ASTM D 412 test method, a compression set (after 22 hours@approximately 75 degrees Fahrenheit) of from between about 2% to 38% using the ASTM D 395 method B test method and a low temperature brittle point of from between about −22 degrees Fahrenheit and −110 degrees Fahrenheit using the ASTM D 746 test method.

39. An actuator and tube overcap assembly as claimed in claim 37 in which said overcap has a top, said side extending at an angle from said top to a bottom edge, one of said top and said actuator has at least one stabilizer extending to the other of said top and said actuator, said one stabilizer having a stabilizing surface contacting said other of said top and said actuator.

40. An actuator and tube overcap assembly as claimed in claim 37 in which one of said top of said overcap and said actuator has a plurality of stabilizers extending to the other of said top of said overcap and said actuator, said stabilizers having a stabilizing surface contacting said other of said top of said overcap and said actuator, said one of said top of said overcap and said actuator having an interconnecting stabilizer formed integrally with two of said stabilizers and extending therebetween, said interconnecting stabilizer having a stabilizing surface contacting said other of said top of said overcap and said actuator.

41. An actuator and tube overcap assembly as claimed in claim 37 in which said overcap has a top, said side extending at an angle from said top to a bottom edge, each of said top and said side having an inner surface, said overcap having at least one tube retaining portion extending from at least one of said top and said side, said one tube retaining portion having an unattached end, said one tube retaining portion having a tube retaining surface, said tube retaining surface extending from said unattached end and spaced from said inner surface of said side, said extension portion of said tube positioned between said tube retaining surface and said inner surface of said side of said overcap.

42. An actuator and tube overcap assembly as claimed in claim 41 in which said extension portion of said flexible discharge tube has an undeformed diameter, at least a portion of said tube retaining surface spaced from said inner surface of said side a distance less than said undeformed diameter of said extension portion of said tube.

43. An actuator and tube overcap assembly as claimed in claim 41 in which said actuator has a valve portion, said extension portion of said tube positioned substantially above said valve portion of said actuator and substantially between said valve portion and said top of said overcap.

44. An actuator and tube overcap assembly as claimed in claim 41 in which said side of said overcap and said tube retaining surface diverge as they extend away from said unattached end of said tube retaining portion.

45. An actuator and tube overcap assembly as claimed in claim 41 in which said inner side of said overcap is at an angle greater than 90 degrees from said inner surface of said top.

46. An actuator and tube overcap assembly as claimed in claim 41 wherein said side extends from said top of said overcap and terminates at a bottom edge, said overcap having a tube holding protrusion extending from one of said tube retaining surface and said inner surface of said side and spaced between said bottom edge of said side and said top of said overcap.

47. An actuator and tube overcap assembly as claimed in claim 46 which includes a connector, said tube having an outlet end opposite said inlet end, said connector attached to said outlet end of said tube, said connector positioned between said tube holding protrusion and said top of said overcap.

48. An actuator and tube overcap assembly as claimed in claim 46 in which said tube holding protrusion contacts said extension portion of said tube.

49. An actuator and tube overcap assembly as claimed in claim 37 having a latch device for removably affixing said actuator to said overcap, said latch device having a locking depression, said locking depression on one of said actuator and said overcap having a locking surface, said latch device having a latch on the other of said actuator and said overcap, said latch movable between an unlatched and latched position, said latch having a retaining portion engaging said locking surface when in said latched position and movable to said unlatched position in which said retaining portion is disengaged from said locking surface.

50. An actuator and tube overcap assembly as claimed in claim 37 in which said actuator and tube overcap assembly is configured to allow the operable assembly of said actuator and tube overcap assembly with the container by automated machinery.

51. An actuator and tube overcap assembly for installation onto a pressurized container, said assembly comprising:

an actuator having an inlet and an outlet, a flexible discharge tube having an inlet end fluidically connected to said outlet of said actuator, an extension portion extending from said inlet end of said tube and a fluid passageway therethrough, and an overcap removably connected to said actuator, said overcap having a having a top and a side extending at an angle from said top to a bottom edge, each of said top and said side having an inner surface, said tube positioned between said inner surface of said side of said overcap, said tube made from a thermoplastic material having a specific gravity from between about 0.98 g/cc and 1.21 g/cc using the ASTM D 792 test method, a durometer hardness of from between about 50 Shore A to 55 Shore D using the ASTM D 2240 test method, and ultimate elongation (%@Break) of from between about 250% to 2,000% using the ASTM D 412 test method, a compression set (after 22 hours@approximately 75 degrees Fahrenheit) of from between about 2% to 38% using the ASTM D 395 method B test method and a low temperature brittle point of from between about−22 degrees Fahrenheit and −110 degrees Fahrenheit using the ASTM D 746 test method.

52. An actuator and tube overcap assembly as claimed in claim 51 wherein each of said top and said side have an inner surface, said overcap having at least one tube retaining portion extending from at least one of said top and said side, said one tube retaining portion having an unattached end, said one tube retaining portion having a tube retaining surface, said tube retaining surface extending from said unattached end and spaced from said inner surface of said side, said extension portion of said tube positioned between said tube retaining surface and said inner surface of said side.

53. An actuator and tube overcap assembly as claimed in claim 51 wherein one of said top and said actuator has at least one stabilizer extending to the other of said top and said actuator, said one stabilizer having a stabilizing surface contacting said other of said top and said actuator.

54. An actuator and tube overcap assembly as claimed in claim 51 wherein said inner surface of said side of said overcap is in contact with said tube and positioned adjacent said outlet of said actuator a distance that substantially closes said fluid passageway of said tube positioned between said side and said outlet of said actuator.

55. A method for assembling an actuator and tube overcap assembly comprising the steps of:

attaching one end of a tube to an outlet of an actuator, positioning said tube in an assembly position within a perimeter to fit between the space between at least one tube retaining surface and the side of said overcap, said overcap having a top and said side extending at an angle from said top, said overcap having at least one internal tube retaining portion having said one tube retaining surface, said one tube retaining surface spaced from said side for receiving said tube therebetween, positioning said tube between said side and one tube retaining surface of said overcap.

56. The product of the method as claimed in claim 55.

57. A method for assembling an actuator and tube overcap assembly as claimed in claim 55 which includes the step of holding said tube in said assembly position after the step of positioning said tube in said assembly position.

58. A method for assembling an actuator and tube overcap assembly as claimed in claim 55 which includes the step of removably affixing said actuator to said overcap after the step of positioning said tube in said assembly position.

59. A method for assembling an actuator and tube overcap assembly as claimed in claim 55 which includes the step of removably affixing said actuator to said overcap simultaneously with the step of positioning said tube between said side and said one tube retaining surface of said overcap.

60. A method for assembling an actuator and tube overcap assembly as claimed in claim 55 in which the step of positioning said tube between said side and said one tube retaining surface of said overcap includes the step of deforming said tube by contact between said side and said one tube retaining surface of said overcap.

61. A method for assembling an actuator and tube overcap assembly with a pressurized container comprising the steps of:

attaching one end of a tube to the outlet of an actuator, wherein said actuator is not attached to said container, positioning said tube in an assembly position within a perimeter to fit between the space between at least one tube retaining surface and the side of said overcap, said overcap having a top and said side extending at an angle from said top, said overcap having at least one internal tube retaining portion having said one tube retaining surface, said one tube retaining surface spaced from said side for receiving said tube therebetween, attaching said tube and said actuator to said overcap wherein said tube is positioned between said side and said tube retaining portions, and operably attaching said actuator and tube overcap assembly to said pressurized container.

62. The product of the method as claimed in claim 61.

63. The method for assembling an actuator and tube overcap assembly with a pressurized container as claimed in claim 61 wherein said step of operably attaching said actuator and tube overcap assembly to said pressurized container is performed by automatic machinery.

* * * * *